US010450832B2

(12) United States Patent
Hickie

(10) Patent No.: US 10,450,832 B2
(45) Date of Patent: Oct. 22, 2019

(54) ISOLATION HEAD AND METHOD OF USE FOR OILFIELD OPERATIONS

(71) Applicant: TECH ENERGY PRODUCTS, L.L.C., Bossier City, LA (US)

(72) Inventor: Barton Hickie, Oklahoma City, OK (US)

(73) Assignee: TECH ENERGY PRODUCTS, L.L.C., Bossier City, LA (US)

( * ) Notice: Subject to any disclaimer, the term of this patent is extended or adjusted under 35 U.S.C. 154(b) by 0 days.

(21) Appl. No.: 16/296,772

(22) Filed: Mar. 8, 2019

(65) Prior Publication Data

US 2019/0277108 A1 Sep. 12, 2019

Related U.S. Application Data

(60) Provisional application No. 62/641,058, filed on Mar. 9, 2018.

(51) Int. Cl.

| | |
|---|---|
| ***E21B 34/02*** | (2006.01) |
| *E21B 43/26* | (2006.01) |
| *E21B 34/00* | (2006.01) |

(52) U.S. Cl.

CPC ..... *E21B 34/02* (2013.01); *E21B 43/26* (2013.01); *E21B 2034/007* (2013.01)

(58) Field of Classification Search

CPC ..... E21B 33/03

See application file for complete search history.

(56) References Cited

U.S. PATENT DOCUMENTS

| | | | | |
|---|---|---|---|---|
| 1,896,236 | A * | 2/1933 | Howard | E21B 33/0415 166/80.1 |
| 8,322,441 | B2 | 12/2012 | Fenton | |
| 2006/0185841 | A1* | 8/2006 | Swagerty | E21B 33/068 166/88.1 |
| 2008/0230226 | A1 | 9/2008 | Lam et al. | |
| 2008/0277120 | A1 | 11/2008 | Hickie | |
| 2009/0090515 | A1 | 4/2009 | Chan et al. | |
| 2009/0211749 | A1 | 8/2009 | Nguyen et al. | |
| 2010/0051261 | A1 | 3/2010 | Koleitat et al. | |
| 2010/0230114 | A1* | 9/2010 | Jennings | E21B 33/038 166/377 |
| 2012/0111573 | A1 | 5/2012 | Bhat | |
| 2017/0081935 | A1 | 3/2017 | Hickie | |

OTHER PUBLICATIONS

International Search Report and Written Opinion issued by the U.S. International Searching Authority regarding International Application No. PCT/US19/21383, dated May 17, 2019, 9 pages.

* cited by examiner

*Primary Examiner* — D. Andrews
(74) *Attorney, Agent, or Firm* — Haynes and Boone, LLP

(57) ABSTRACT

A method and apparatus according to which at least part of a wellhead is fluidically isolated from excessive pressures, temperatures, and/or flow rates during a wellbore operation using an isolation head, the isolation head including an isolation spool and an isolation sleeve.

27 Claims, 16 Drawing Sheets

ISOLATION HEAD AND METHOD OF USE FOR OILFIELD OPERATIONS

CROSS-REFERENCE TO RELATED APPLICATION

This application claims the benefit of the filing date of, and priority to, U.S. Application No. 62/641,058, filed Mar. 9, 2018, the entire disclosure of which is hereby incorporated herein by reference.

TECHNICAL FIELD

The present disclosure relates generally to oil or gas wellbore equipment, and, more particularly, to an isolation head for fluidically isolating at least part of a wellhead from excessive pressures, temperatures, and/or flow rates during a wellbore operation.

BACKGROUND

Many oilfield operations expose wellhead equipment at the surface of a subterranean wellbore to extreme conditions—examples of such oilfield operations include cementing, acidizing, injecting, fracturing, and/or gravel packing of the wellbore. Isolation tools are available that attempt to protect wellhead equipment from excessive pressures, temperatures, and flow rates encountered during oilfield operations, but these isolation tools are often insufficient to handle extreme duty cycles. For example, during fracturing of the wellbore, the wellhead equipment may be subject to a fluid pressure of up to 20,000 psi or more. Some isolation tools are configured to position and secure a mandrel within a wellhead, which mandrel includes a packoff assembly adapted to isolate the wellhead from fluid flowing through the mandrel to and from the wellbore. However, the high pressures and flow rates encountered during wellbore fracturing operations often cause packoff assemblies to "lift-off" from a sealing surface, allowing the fracturing fluid or slurry to leak or blow by the packoff assembly into the wellhead equipment. For this reason (among others), existing isolation tools are susceptible to blowouts (i.e., the uncontrolled release of oil and/or gas from the wellbore). To make matters worse, if a blowout does occur, there is no simple way to stop the blowout using existing isolation tools. Therefore, what is needed is an apparatus, system, or method that addresses one or more of the foregoing issues, and/or one or more other issues.

DETAILED DESCRIPTION

Figure 1A:
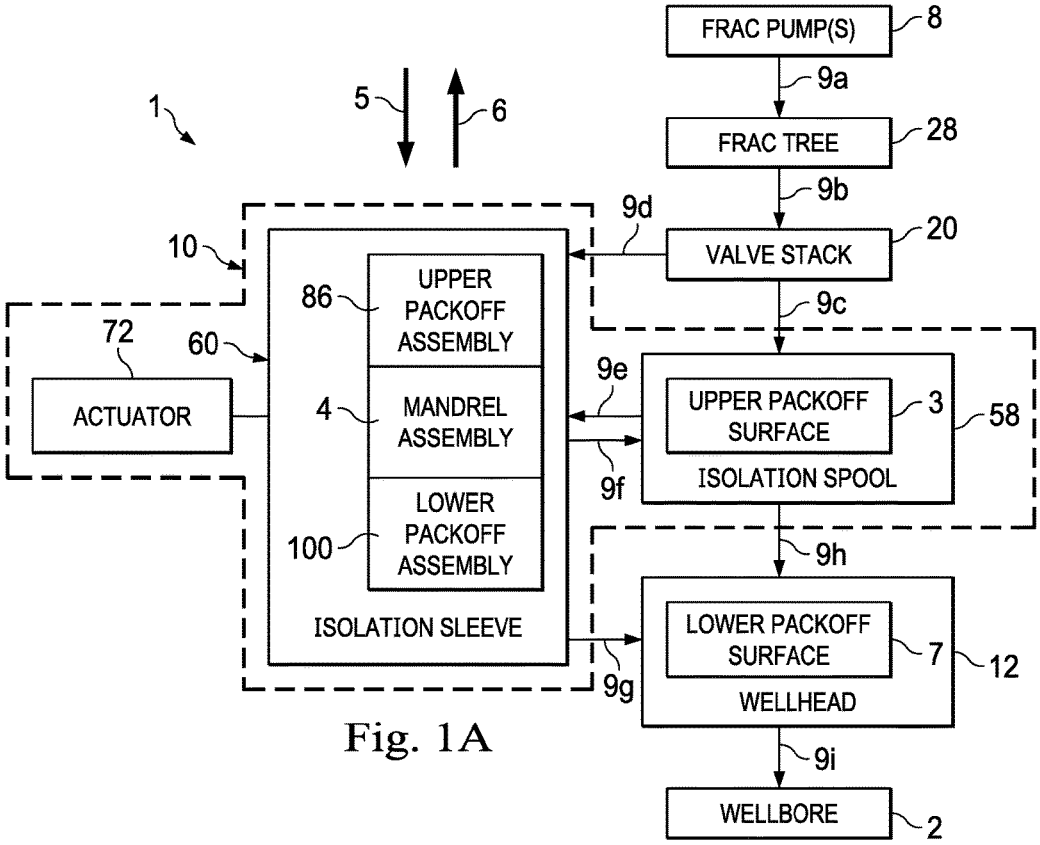
FIG. 1A is a diagrammatic illustration of a fracturing (or "frac") system including an isolation head, the isolation head including an isolation spool and an isolation sleeve, the isolation sleeve being positioned so as not to fluidically isolate the wellhead from fluid flowing through the isolation head, according to one or more embodiments of the present disclosure.

Referring to FIG. 1A, in an embodiment, a fracturing (or "frac") system is diagrammatically illustrated and generally referred to by the reference numeral 1. The frac system 1 is adapted to communicate fluid (e.g., containing a carrier fluid and a particulate material) into a wellbore 2 that traverses a subterranean formation for various oilfield operations such as, for example, fracturing or gravel packing operations. In this regard, the frac system 1 can be designed to communicate various types of fluids desired to be deposited into the wellbore 2 for a particular oil and gas operation; for example, the fluid can be a fracturing or gravel packing fluid used in fracturing or gravel packing operations. The frac system 1 includes an isolation head 10. In some embodiments, as in FIG. 1A, the isolation head 10 includes an isolation spool 58, an isolation sleeve 60, and an actuator 72. The isolation spool 58 includes an upper packoff surface 3. The isolation sleeve 60 includes an upper packoff assembly 86, a mandrel assembly 4, and a lower packoff assembly 100.

The actuator 72 is operably associated with the isolation spool 58. In addition, the actuator 72 is operably associated with, and adapted to displace, the isolation sleeve 60. In some embodiments, as in FIG. 1A, the actuator 72 facilitates movement of the isolation sleeve 60 in opposing directions, as indicated by arrows 5 and 6. The actuator 72 may be, include, or be part of, motor(s), cylinder actuator(s), other actuators powered by electric, pneumatic, or hydraulic power, or any combination thereof. In some embodiments, one or more position sensors can be operably associated with the isolation sleeve 60 and adapted to detect the position of the isolation sleeve 60. The position sensor(s) may be, include, or be part of encoder(s), linear position transducer(s), wire potentiometer(s), another transducer capable of translating linear motion into a mechanical or electrical signal, or any combination thereof.

The frac system 1 is operably associated with a wellhead 12, which wellhead 12 serves as the surface termination of the wellbore 2. The wellhead 12 includes a lower packoff surface 7. A valve stack 20 is operably associated with the isolation head 10, opposite the wellhead 12. A fracturing (or "frac") tree 28 is operably associated with the valve stack 20. In some embodiments, the valve stack 20 is part of the frac tree 28; accordingly, the valve stack 20 and the frac tree 28 may be collectively referred to herein as the "frac tree". One or more fracturing (or "frac") pumps 8 may be operably associated with, and adapted to pump fluid to, the frac tree 28. Any fluid communicated to the frac tree 28 from the frac pump(s) 8 travels into the wellbore 2 only after passing through the wellhead 12. In some embodiments, one or more other oil and gas tools can be operably associated with the wellhead 12 and located between the isolation head 10 and the wellhead 12. Accordingly, in such embodiments, any fluid communicated to the frac tree 28 from the frac pump(s) 8 travels into the wellbore 2 only after passing through the other oil and gas tool(s) and the wellhead 12.

In operation, the actuator 72 moves the isolation sleeve 60 relative to the isolation spool 58 and the wellhead 12 to sealingly engage the upper and lower packoff assemblies 86 and 100 with the upper and lower packoff surfaces 3 and 7, respectively. When the upper and lower packoff assemblies 86 and 100 are sealingly engaged with the upper and lower packoff surfaces 3 and 7, respectively, the isolation sleeve 60 isolates at least a portion of the wellhead 12 from fluid flowing through the isolation head 10. However, as shown in FIG. 1A, prior to the upper and lower packoff assemblies 86 and 100 being sealingly engaged with the upper and lower packoff surfaces 3 and 7, respectively, the isolation sleeve 60 does not isolate the wellhead 12 from fluid flowing through the isolation head 10. The operation of the frac system 10 and, more particularly, the isolation spool 10, will be described in further detail below.

Figure 1B:
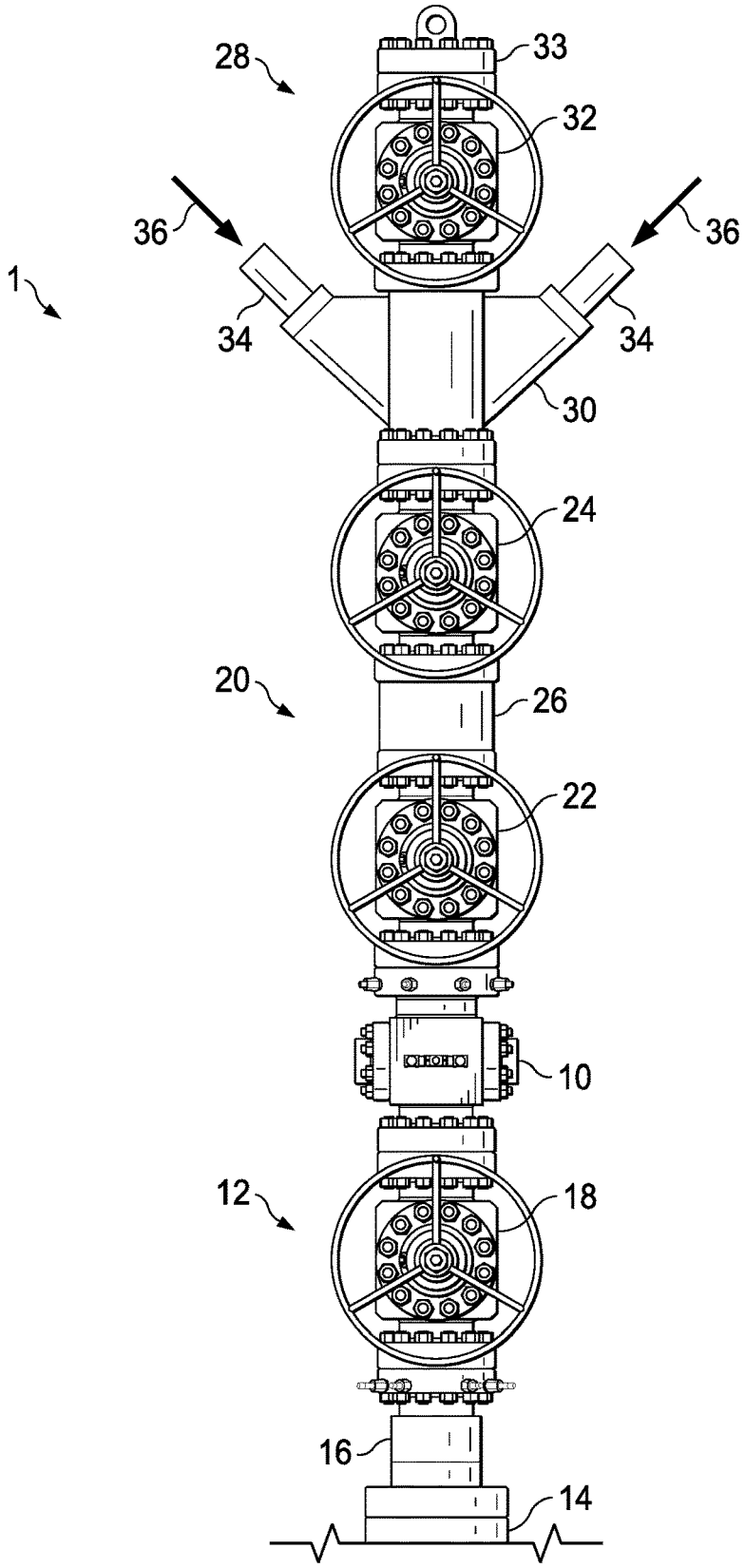
FIG. 1B is an elevational view of the frac system of FIG. 1A, according to one or more embodiments of the present disclosure.

Referring to FIG. 1B, with continuing reference to FIG. 1A, in an embodiment, the isolation head 10 is connected to the wellhead 12 and is adapted to fluidically isolate at least a portion of the wellhead 12 from fluid flowing through the isolation head 10. The wellhead 12 is connected at the surface termination of the wellbore 2 and includes one or more wellhead components, such as, for example, a casing head 14, a tubing spool 16 connected to the casing head 14, and an isolation valve 18 connected to the tubing spool 16. In some embodiments, at least the isolation head 10 and the lower packoff surface 7 of the wellhead 12 together form a wellhead isolation tool. In some embodiments, the casing head 14 and/or the tubing spool 16 is/are adapted to receive a casing string and/or a tubing string, one or both of which may include a bit guide for guiding downhole tools into the wellbore 2. In some embodiments, at least an uppermost portion of such a casing string can be considered part of the wellhead 12. In some embodiments, in addition, or instead, at least an uppermost portion of such a tubing string can be considered part of the wellhead 12. In addition to, or instead of, the casing head 14, the tubing spool 16, and the isolation valve 18, the wellhead 12 may include one or more other wellhead components, such as, for example, a casing spool, a casing hanger, a tubing head, a tubing hanger, a packoff seal, a valve tree, a blowout preventer, choke equipment, another wellhead component, or any combination thereof.

Referring still to FIG. 1B, the valve stack 20 is connected to the isolation head 10, opposite the wellhead 12, and includes valves 22 and 24 configured to either prevent or allow the flow of a fluid through the valve stack 20. The valve 22 is connected to the isolation head 10. The valve stack 20 also includes a fluid block 26 connected between the valves 22 and 24. The fluid block 26 includes an internal passage through which a fluid is communicated between the valves 22 and 24. The fluid block 26 may also include one or more diverter passages extending into the internal passage of the fluid block 26, and through which fluid may be communicated to and/or from the internal passage of the fluid block 26. In some embodiments, in addition to, or instead of, the valves 22 and 24, the valve stack 20 includes one or more other valves.

In some embodiments, to facilitate, for example, fracturing and/or gravel packing of the wellbore 2, the frac tree 28 is connected to the valve stack 20, opposite the isolation head 10, as shown in FIG. 1B. The frac tree 28 includes a goat head 30 and a swab valve 32. The goat head 30 is connected to the valve stack 20 and includes a plurality of fluid inlets 34 adapted to communicate, for example, fracturing or gravel packing fluid to the wellbore 2, as indicated by the arrows 36 in FIG. 1B. The swab valve 32 is connected to the goat head 30, opposite the valve stack 20, and provides vertical access to the wellbore 2 for well interventions (e.g., using wireline or coiled tubing). In some embodiments, a blind flange 33 is connected to the swab valve 32 to prevent, or at least reduce, fluid from leaking to atmosphere from the swab valve 32, and/or to provide a lifting point for lowering the frac tree 28 onto the valve stack 20.

Figure 2:
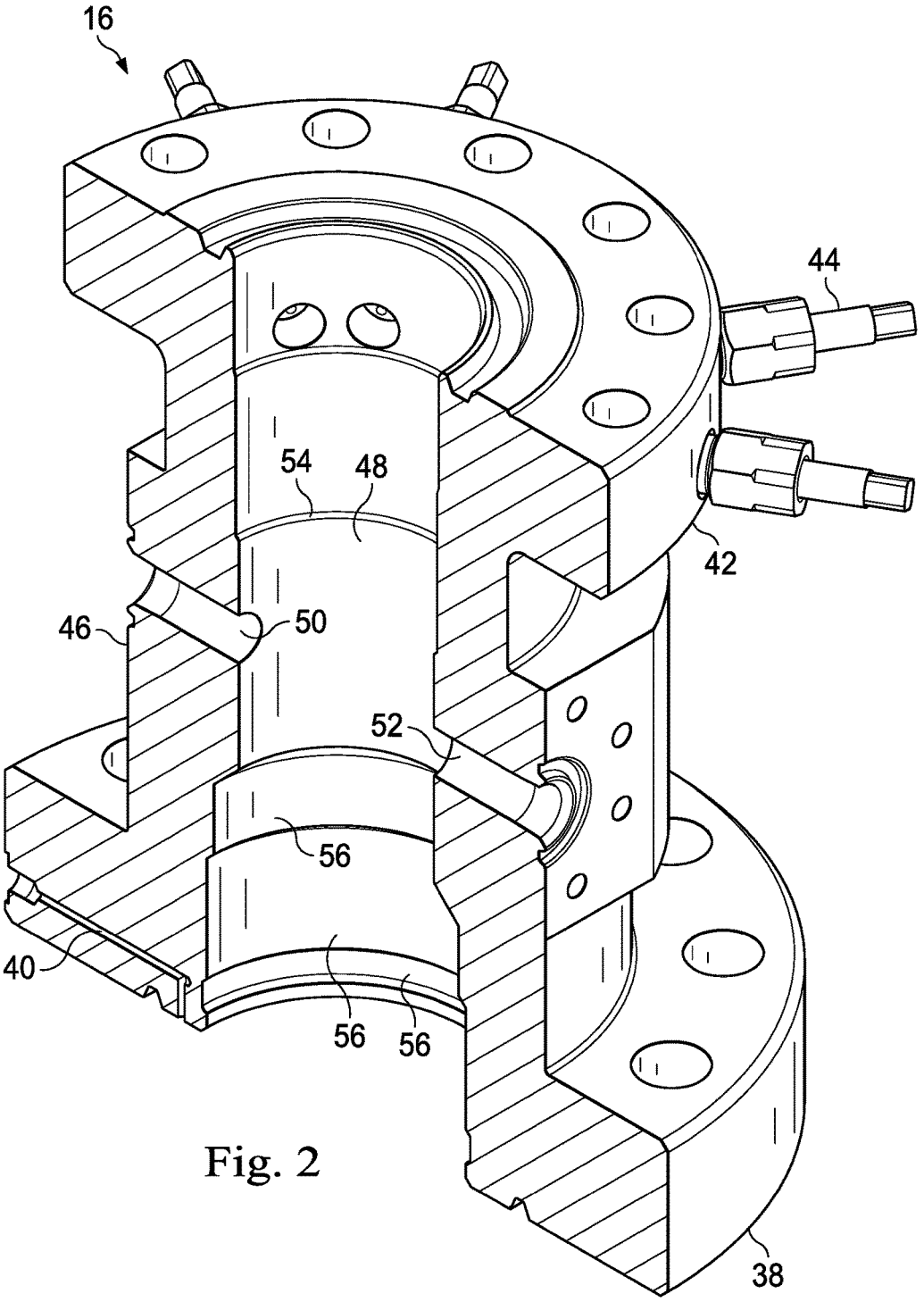
FIG. 2 is a perspective cross-sectional view of a tubing spool of the frac system of FIG. 1B, according to one or more embodiments of the present disclosure.

Referring to FIG. 2 with continuing reference to FIG. 1B, in an embodiment, the tubing spool 16 of the wellhead 12 includes a lower flange 38, a leak investigation port 40, and upper flange 42, a plurality of lockdown pins 44, a body 46, an internal passage 48, access ports 50 and 52, and a landing shoulder 54. The lower flange 38 is connectable to the casing head 14 (shown in FIG. 1B). The leak investigation port 40 is formed in the lower flange 38 and configured to permit pressure testing of the bit guide and or other components of the wellhead 12. The isolation valve 18 (or another component of the wellhead 12) is configured to be connected to the upper flange 42 of the tubing spool 16. The body 46 extends between the lower flange 38 and the upper flange 42, and the internal passage 48 extends longitudinally through the lower flange 38, the body 46, and the upper flange 42. The internal passage 48 defines annular recesses 56 in the tubing spool 16 adjacent the lower flange 38, at least one of the annular recesses 56 being configured to accommodate the bit guide. The access ports 50 and 52 extend radially through the body 46 and into the internal passage 48. Once the desired hydrocarbon production has been established (e.g., after fracturing and/or gravel packing operations have been completed), the landing shoulder 54 of the tubing spool 16 is configured to support a tubing hanger from which production tubing extends into the wellbore 2. In this regard, the plurality of lockdown pins 44 are configured to secure the tubing hanger against the landing shoulder 54. In some embodiments, the lower packoff surface 7 (shown in FIG. 1A) may be defined in the tubing spool 16 by, for example, the internal passage 48. Alternatively, the lower packoff surface 7 may be defined elsewhere in the tubing spool 16 or in some other component of the wellhead 12.

Figure 3:
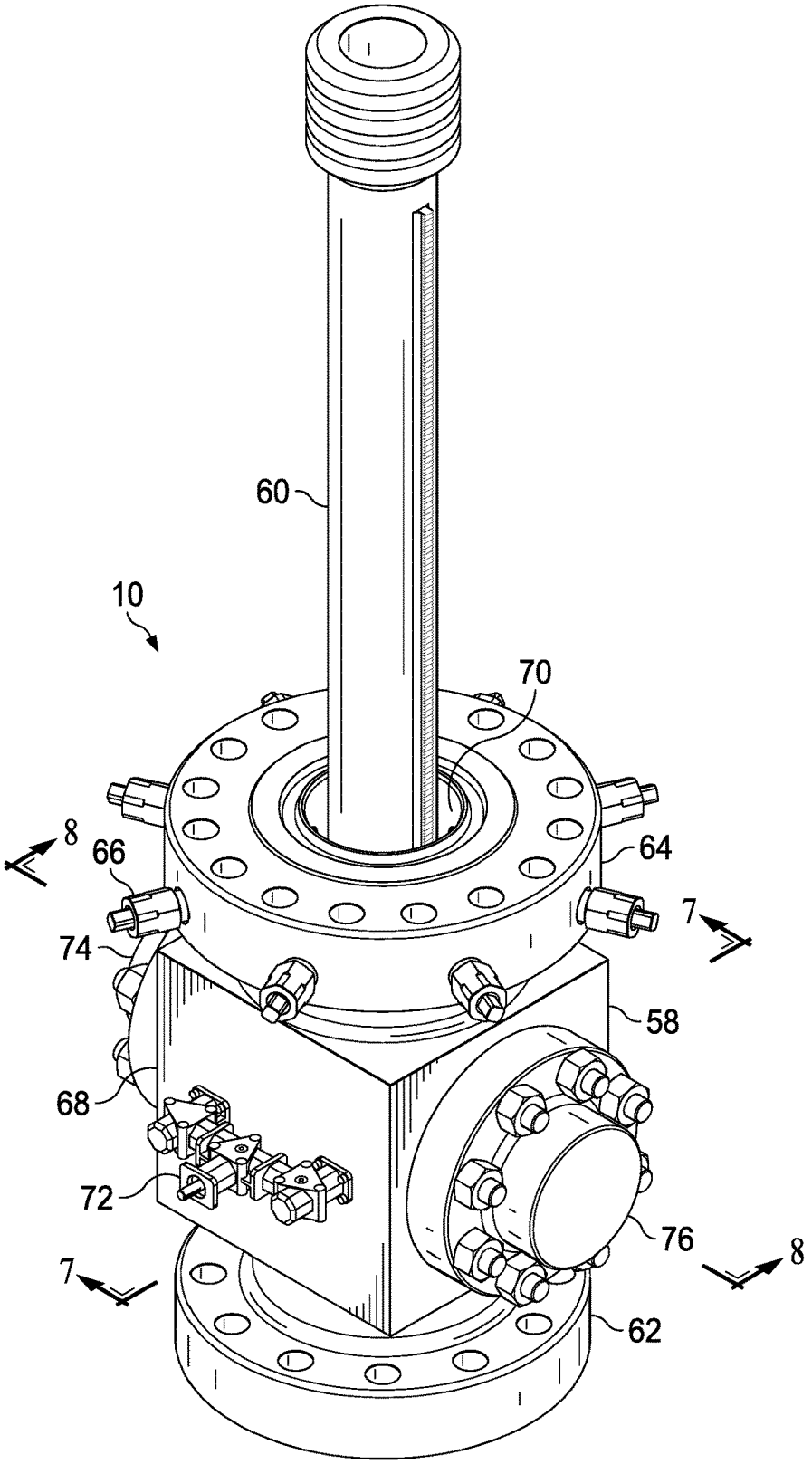
FIG. 3 is a perspective view of an isolation head of the frac system of FIG. 1B, according to one or more embodiments of the present disclosure.

Referring to FIG. 3 with continuing reference to FIG. 1B, in an embodiment, the isolation head 10 includes the isolation spool 58 and the isolation sleeve 60. The isolation spool 58 includes a lower flange 62, an upper flange 64, a plurality of lockdown pins 66, a spool body 68, an internal passage 70, the actuator 72, and actuator support flanges 74 and 76. The lower flange 62 of the isolation spool 58 is connectable to the isolation valve 18 (or another component of the wellhead 12). Similarly, the valve stack 20 is connectable to the upper flange 64 of the isolation spool 58. The spool body 68 extends between the lower flange 62 and the upper flange 64, and the internal passage 70 extends longitudinally through the lower flange 62, the spool body 68, and the upper flange 64. In some embodiments, the upper packoff surface 3 (shown in FIG. 1A) may be defined in the isolation spool 58 by, for example, the internal passage 70. The actuator support flanges 74 and 76 are connected to the spool body 68 of the isolation spool 58 and are each configured to support at least respective portions of the actuator 72, as will be described in further detail below. The lockdown pins 66 are configured to secure the isolation sleeve 60 against a landing shoulder 78 (shown in FIG. 11C) of the isolation spool 58, as will be described in further detail below.

Figure 4:
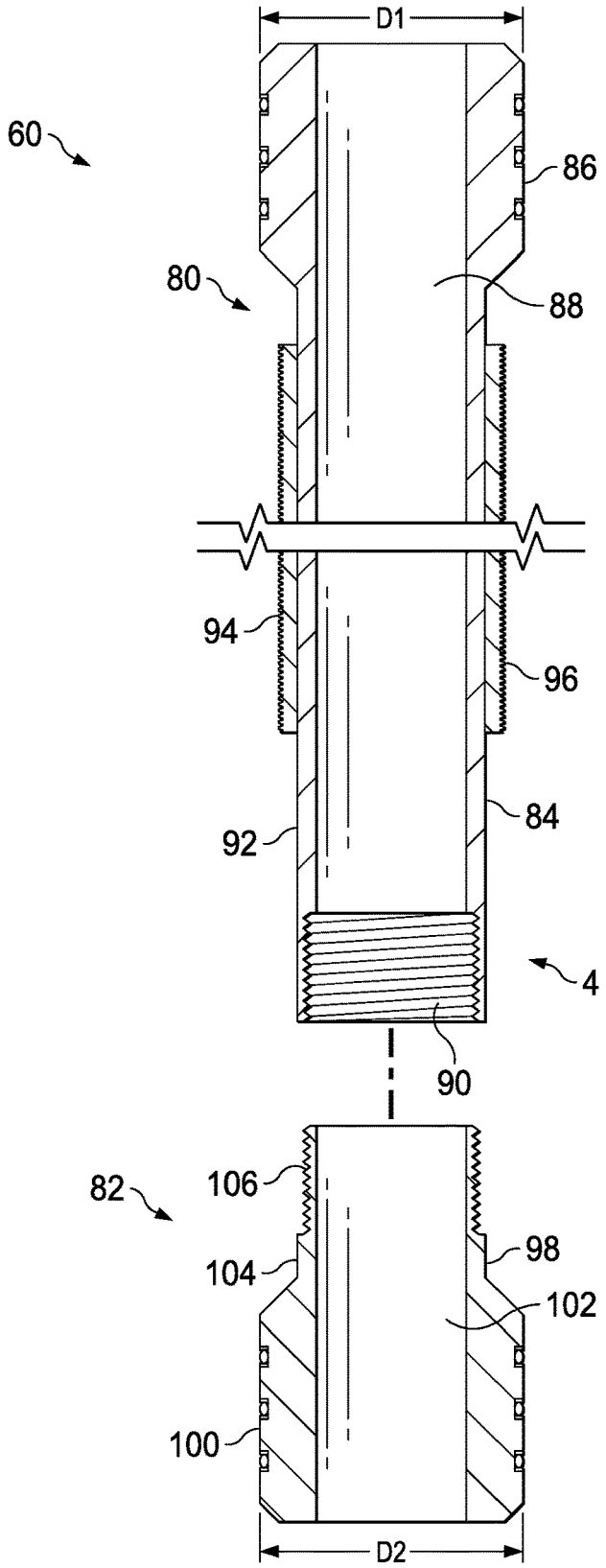
FIG. 4 is a cross-sectional view of an isolation sleeve of the isolation head of FIG. 3, according to one or more embodiments of the present disclosure.

Referring to FIG. 4, in an embodiment, the mandrel assembly 4 of the isolation sleeve 60 includes a mandrel 80 and a mandrel extension 82. The mandrel 80 includes a mandrel body 84, the upper packoff assembly 86, an internal passage 88, an internal connection 90, an external surface 92, and rack gears 94 and 96. The upper packoff assembly 86 is connected to an upper end portion of the mandrel body 84 and is configured to seal against the upper packoff surface 3 (shown in FIG. 1A) of the isolation spool 58, as will be described in further detail below. The upper packoff assembly 86 has a diameter D1. In some embodiments, the upper packoff assembly 86 and the mandrel body 84 are integrally formed. The internal passage 88 extends longitudinally through the mandrel body 84 and the upper packoff assembly 86. The internal connection 90 is formed in an end portion of the mandrel body 84 opposite the upper packoff assembly 86. In some embodiments, as FIG. 4, the internal connection 90 is a female threaded connection. The rack gears 94 and 96 are connected to the external surface 92 of the mandrel body 84 and extend longitudinally along different sides of the mandrel body 84. In some embodiments, the rack gears 94 and 96 are integrally formed with the mandrel body 84.

Referring still to FIG. 4, the mandrel extension 82 includes a mandrel extension body 98, the lower packoff assembly 100, an internal passage 102, an external surface 104, and an external connection 106. The lower packoff assembly 100 is connectable to a lower end portion of the mandrel extension body 98 and is configured to seal against, for example, the lower packoff surface 7 (shown in FIG. 1A) of the wellhead 12, as will be described in further detail below. The lower packoff assembly 100 has a diameter D2. In some embodiments, the diameter D2 of the lower packoff assembly 100 less than the diameter D1 of the upper packoff assembly 86. In some embodiments, the lower packoff assembly 100 and the mandrel extension body 98 are integrally formed. The internal passage 102 extends longitudinally through the mandrel body 84 and the lower packoff assembly 100. The external connection 106 is formed in an end portion of the mandrel extension body 98 opposite the lower packoff assembly 100. In some embodiments, as in FIG. 4, the external connection 106 is a male threaded connection. The external connection 106 of the mandrel extension 82 is connectable to the internal connection 90 of the mandrel 80. Alternatively, in some embodiments, the internal connection 90 of the mandrel 80 is omitted and replaced with an external connection, and the external connection 106 of the mandrel extension 82 is omitted and replaced with an internal connection that is connectable to the external connection of the mandrel 80.

Figure 5:
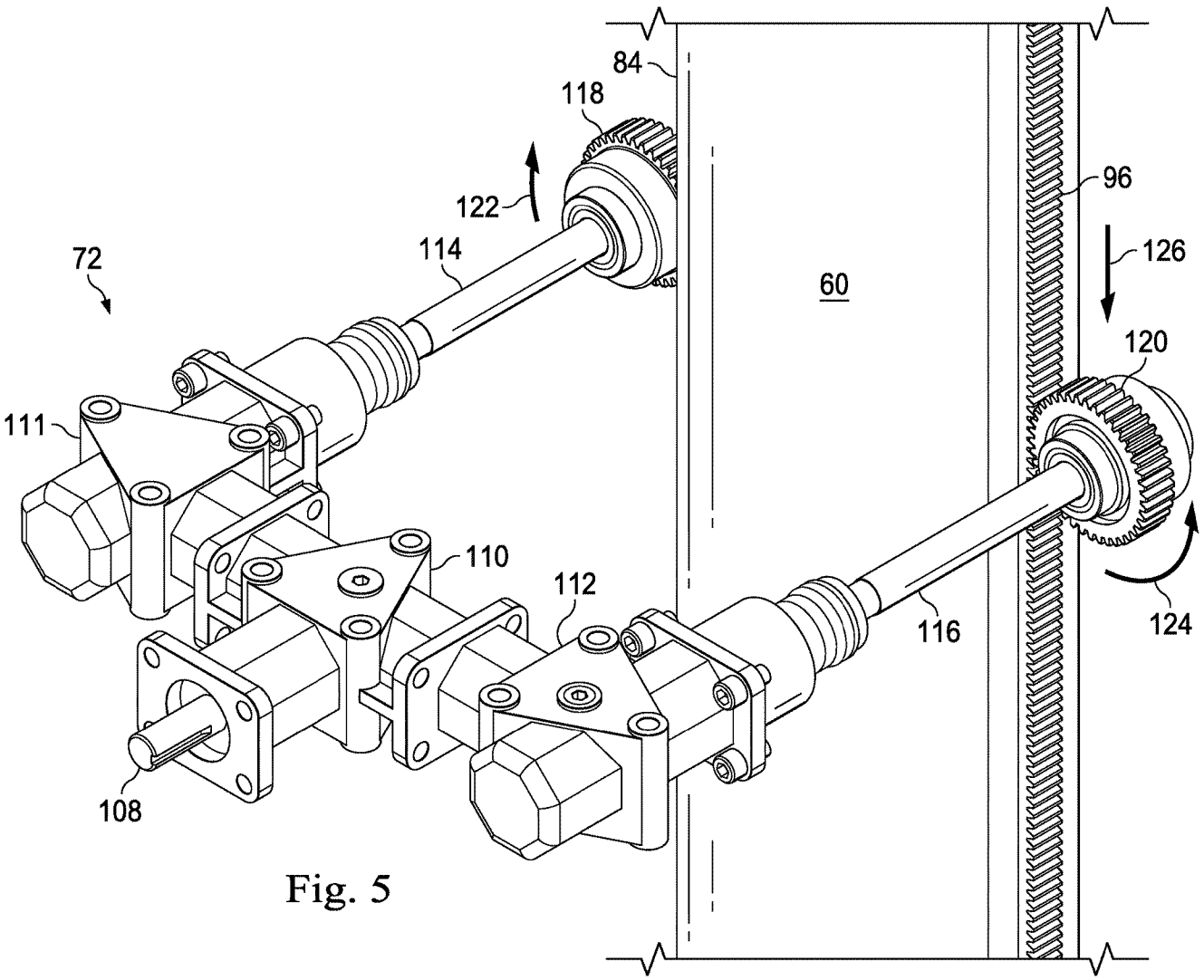
FIG. 5 is a perspective view of an actuator of the isolation head of FIG. 3, according to one or more embodiments of the present disclosure.

Referring to FIG. 5, in an embodiment, the actuator 72 includes an input driveshaft 108, an input gearbox 110 connected to the input driveshaft 108, output gearboxes 111 and 112 connected to the input gearbox 110, output driveshafts 114 and 116 connected to the output gearboxes 111 and 112, respectively, and pinion gears 118 and 120 connected to the output driveshafts 114 and 116, respectively. The pinion gears 118 and 120 matingly engage the rack gears 94 and 96, respectively, connected to the mandrel body 84. As a result, rotation of the input driveshaft 108 in one direction (e.g., clockwise) drives the input gearbox 110 and the output gearboxes 111 and 112 so that the output driveshafts 114 and 116 rotate the pinion gears 118 and 120 in directions indicated by the curvilinear arrows 122 and 124, respectively, thereby causing the isolation sleeve 60 to move longitudinally in a direction indicated by the straight arrow 126. Similarly, rotation of the input driveshaft 108 in the opposite direction (e.g., counterclockwise) drives the input gearbox 110 and the output gearboxes 111 and 112 so that the output driveshafts 114 and 116 rotate the pinion gears 118 and 120 in directions opposite the directions indicated by the curvilinear arrows 122 and 124, respectively, thereby causing the isolation sleeve 60 to move longitudinally in a direction opposite the direction indicated by the straight arrow 126.

Figure 6:
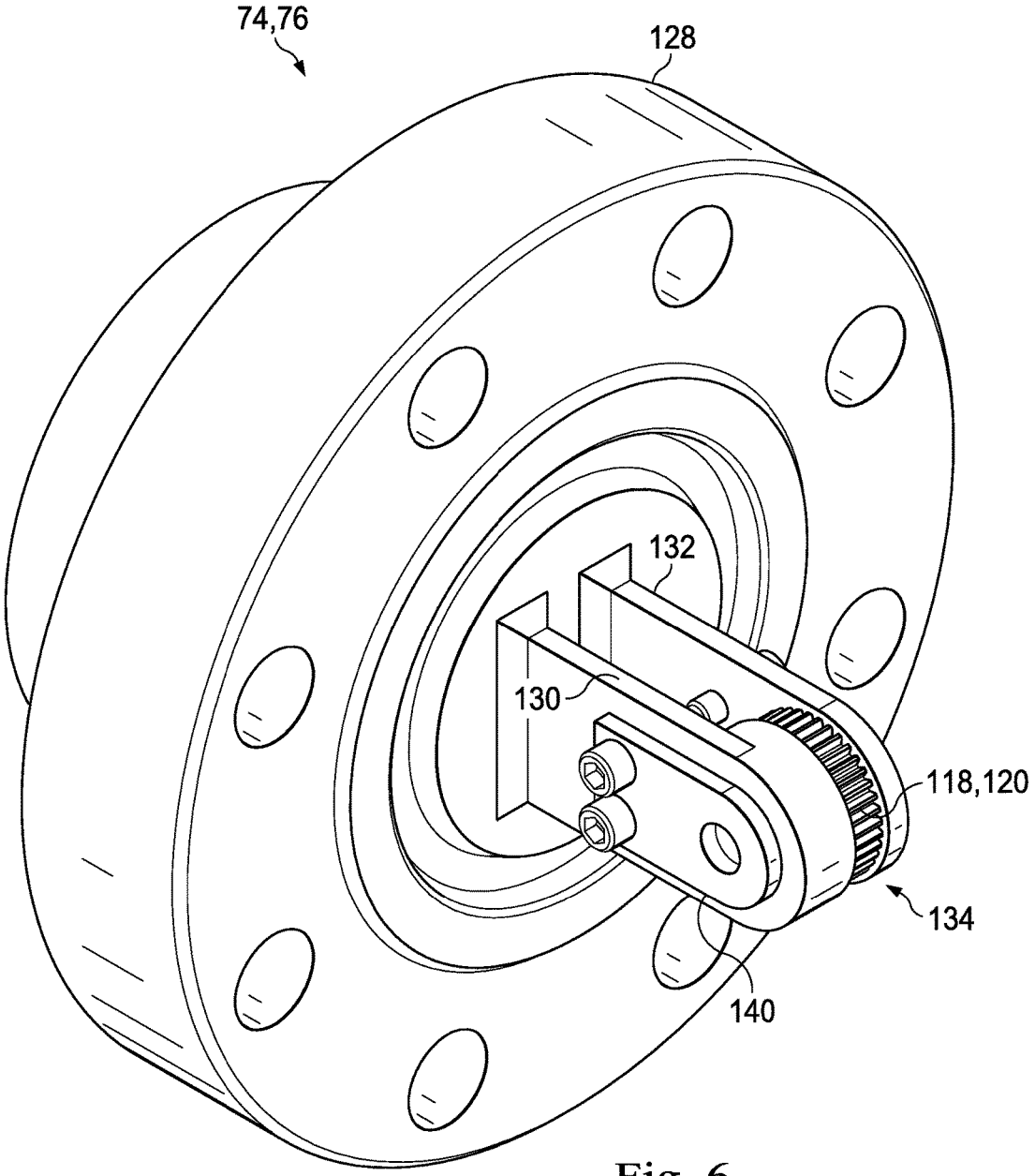
FIG. 6 is a perspective view of an actuator support flange of the isolation head of FIG. 3, according to one or more embodiments of the present disclosure.

Referring to FIG. 6, in an embodiment, the actuator support flanges 74 and 76 each include a blind flange 128 and support plates 130 and 132 connected to the blind flange 128. The support plates 130 and 132 together form a bearing housing 134 that accommodates one or the other of the pinion gears 118 and 120 and bearings 136 and 138 (shown in FIG. 7) that are configured to rotatably support one or the other of the output driveshafts 114 and 116. The support plates 130 and 132 include bearing retainers 140 and 142 (shown in FIG. 7), respectively, connected thereto for retaining the bearings 136 and 138 and one or the other of the pinion gears 118 and 120 within the bearing housing 134.

Figure 7:
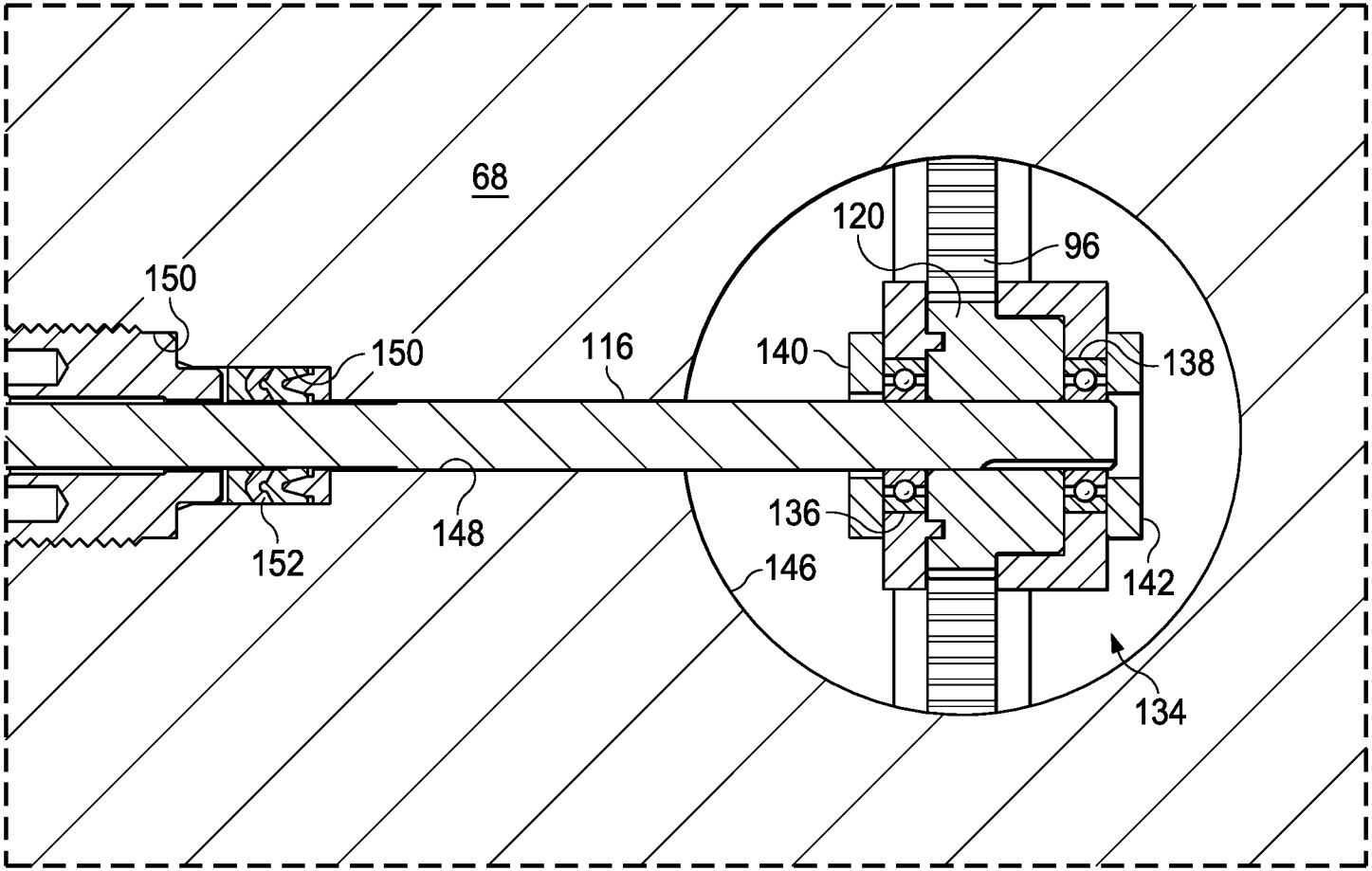
FIG. 7 is a cross-sectional view of the isolation head of FIG. 3 taken along the line 7-7 of FIG. 3, according to one or more embodiments of the present disclosure.
Figure 8:
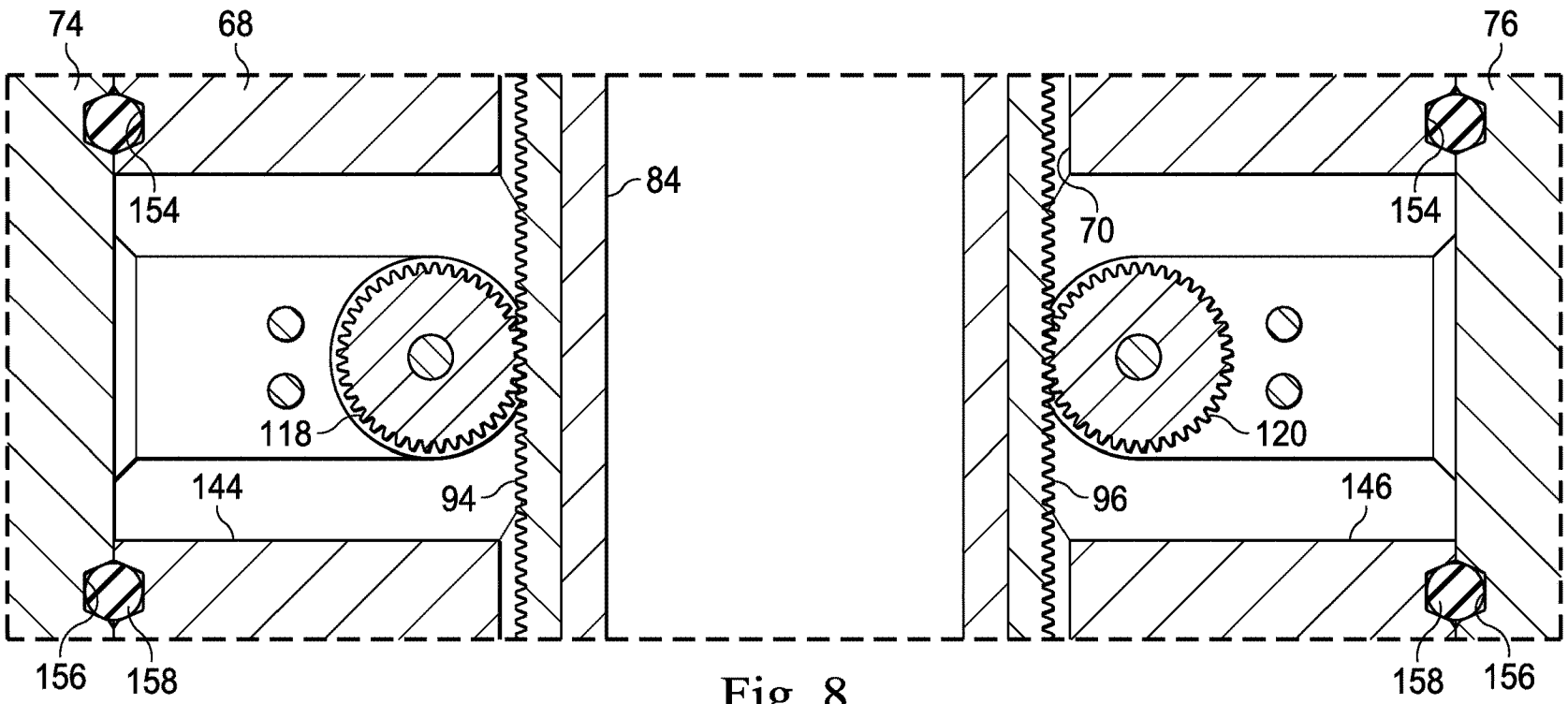
FIG. 8 is a cross-sectional view of the isolation head of FIG. 3 taken along the line 8-8 of FIG. 3, according to one or more embodiments of the present disclosure.

Turning also to FIGS. 7 and 8, the spool body 68 includes access passages 144 and 146 extending into the internal passage 70 of the isolation spool 58, and drive ports 148 extending into the access passages 144 and 146, respectively. The bearing housings 134 of the actuator support flanges 74 and 76 extend within the access passages 144 and 146, respectively, so that the pinion gears 118 and 120 matingly engage the rack gears 94 and 96, respectively, connected to the mandrel body 84. The drive ports 148 each accommodate one or the other of the output driveshafts 114 and 116. Moreover, as shown in FIG. 7, annular recesses 150 are formed in the spool body 68 at end portions of the drive ports 148 opposite the access passages 144 and 146, respectively, the annular recesses 150 each accommodate a seal 152 (e.g., a packing seal or the like) to prevent, or at least reduce, fluid from leaking through the drive ports 148 to atmosphere. Finally, as shown in FIG. 8, corresponding pairs of annular grooves 154 and 156 are formed in the isolation spool 58 and the actuator support flanges 74 and 76—each pair of annular grooves 154 and 156 accommodates a seal 158 to prevent, or at least reduce, fluid from leaking through the access passages 144 and 146 to atmosphere.

Figure 9:
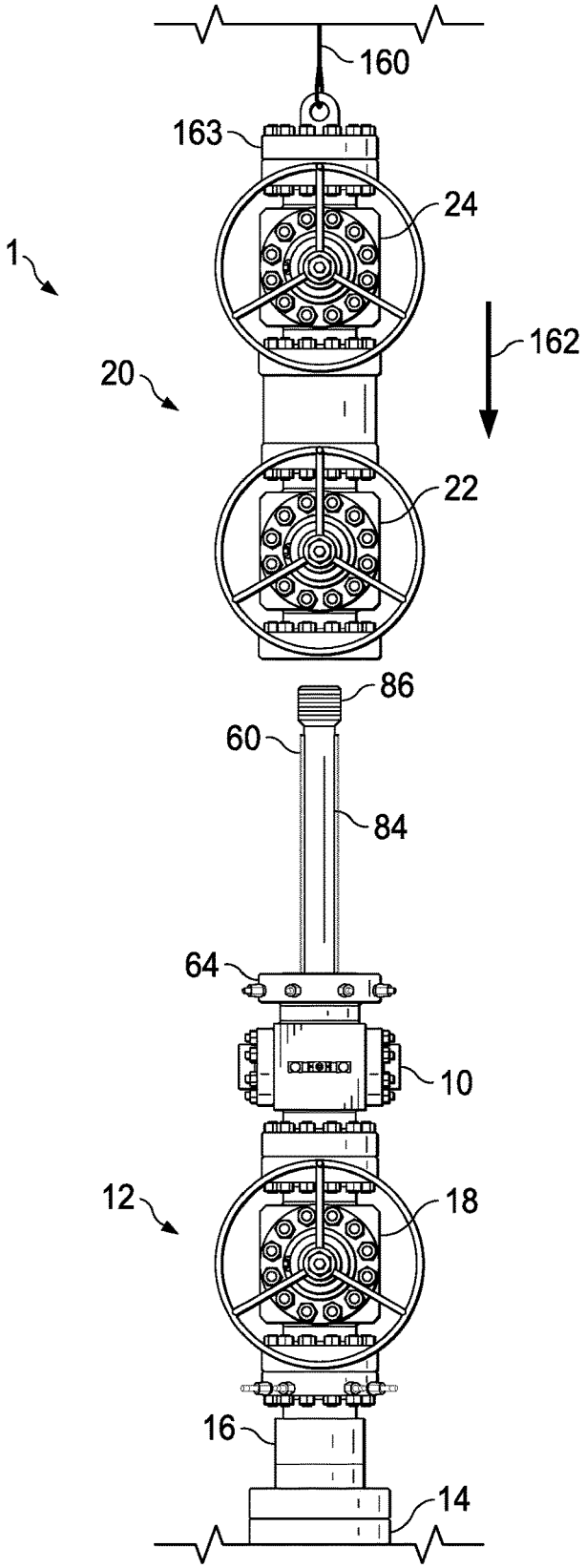
FIG. 9 is an elevational view of the frac system of FIG. 1B in a first operational state or configuration, according to one or more embodiments of the present disclosure.

In operation, in an embodiment, as illustrated in FIGS. 9, 10, and 11A-11D, with continuing reference to FIGS. 1A, 1B, and 2-8, the isolation head 10 is used to fluidically isolate at least a portion of the wellhead 12 from fluid flowing through the isolation head 10. In order to fluidically isolate the at least part of the wellhead 12, the isolation head 10 is first connected to the isolation valve 18 (or another component) of the wellhead 12, as shown in FIG. 9. Before the isolation head 10 is connected to the wellhead 12, the isolation valve 18 is stroked to, or remains in, a closed configuration to prevent the communication of wellbore fluids to atmosphere. In some embodiments, when the isolation head 10 is connected to the wellhead 12, the isolation sleeve 60, including the upper packoff assembly 86 and at least part of the mandrel body 84, protrudes upwardly (as viewed in FIG. 9) from the internal passage 70 and above the upper flange 64 of the isolation head 10. Once the isolation head 10 has been so connected to the wellhead 12, the valve stack 20 is suspended over the isolation head 10 and lowered using a cable 160 in a downward direction 162. In some embodiments, a blind flange 163 is connected to the valve 24 to prevent, or at least reduce, fluid from leaking to atmosphere from the valve stack 20, and/or to provide a lifting point for lowering the valve stack 20 onto the isolation head 10. In some embodiments, when the valve stack 20 is suspended over the isolation head 10, the valve 22, the valve 24, or both the valve 22 and the valve 24 are stroked to an open configuration to allow the valve stack 20 to "swallow" the upwardly protruding isolation sleeve 60 as the valve stack 20 is lowered in the downward direction 162.

Figure 10:
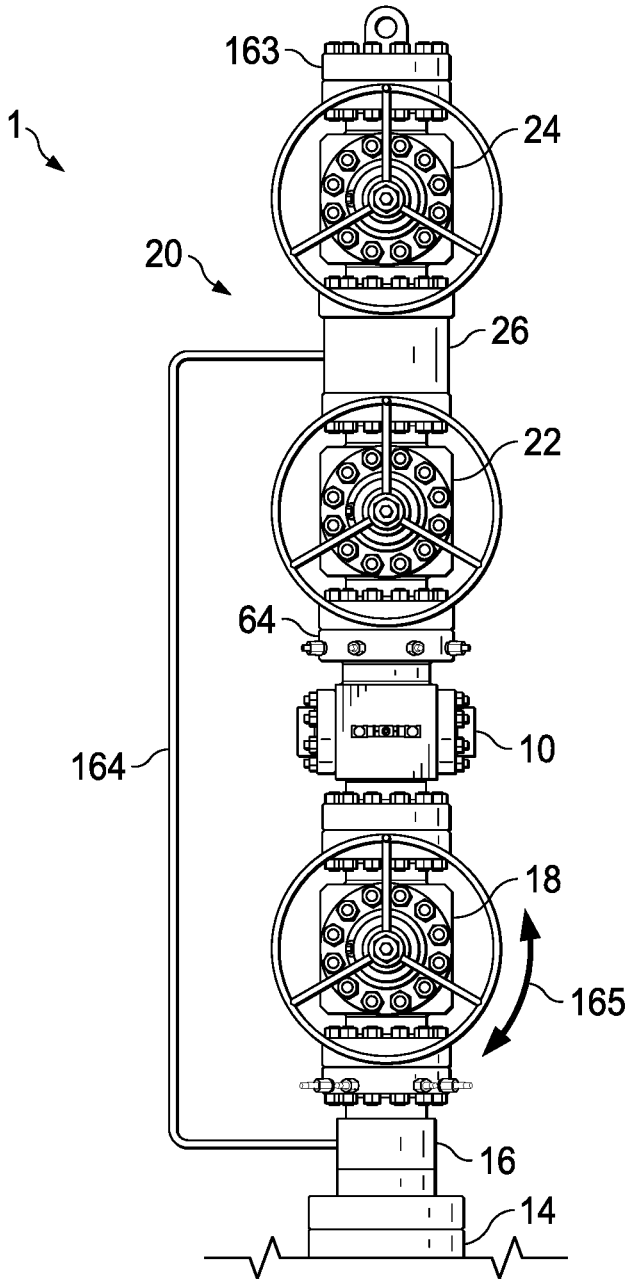
FIG. 10 is an elevational view of the frac system of FIG. 9 in a second operational state or configuration, according to one or more embodiments of the present disclosure.

As shown in FIG. 10, once the valve stack 20 has been completely lowered onto the isolation head 10 in the downward direction 162 using the cable 160 so that the upwardly protruding isolation sleeve 60 is "swallowed" by the valve 22, the valve 24, or both the valve 22 and the valve 24, the valve stack 20 is connected to the isolation head 10 via the upper flange 64, and a fluid line 164 is connected between the tubing spool 16 and the fluid block 26. For example, in some embodiments, the fluid line 164 may be connected between one, or both, of the access ports 50 and 52 of the tubing spool 16 and one or more of the diverter passages extending into the internal passage of the fluid block 26. Once the fluid line 164 is connected between the tubing spool 16 and the fluid block 26, fluid communication can be established, via the fluid line 164, between the internal passage 48 of the tubing spool 16 and the internal passage of the fluid block 26. Such fluid communication between the tubing spool 16 and the fluid block 26 permits pressure equalization across the closed isolation valve 18 (i.e., above and below the isolation valve 18 as viewed in FIG. 10), thereby enabling the isolation valve 18 to be more easily stroked to an open configuration. Thus, after pressure equalization is permitted across the closed isolation valve 18 using the fluid line 164, the isolation valve 18 can be opened, as indicated by the curvilinear arrow 165. Although described as being connected between the tubing spool 16 and the fluid block 26, the fluid line 164 (or another fluid line) may instead be connected between various other suitable locations to produce the desired pressure equalization on opposing sides of the isolation valve 18. For example, the fluid line 164 may be connected between any component of the wellhead 12 and any component of the isolation head 10, the valve stack 20, and/or the frac tree 28.

Turning briefly back to FIG. 1A, before the upper and lower packoff assemblies 86 and 100 are sealingly engaged with the upper and lower packoff surfaces 3 and 7, respectively, the isolation sleeve 60 does not isolate the wellhead 12 from fluid flowing through the isolation head 10. Instead, the frac pump(s) 8 are allowed to communicate fluid to the wellbore 2 along two separate flow paths, at least one of which includes the wellhead 12. The first flow path is indicated by arrows 9*a*, 9*b*, 9*c*, 9*h*, 9*i*. More particularly, fluid traveling along the first flow path does not enter the isolation sleeve 60, but is instead is communicated: from the frac pump(s) 8 to the frac tree 28, as indicated by the arrow 9*a*; from the frac tree 28 to the valve stack 20, as indicated by the arrow 9*b*; from the valve stack 20 to the isolation spool 58, as indicated by the arrow 9*c*; from the isolation spool 58 to the wellhead 12, as indicated by the arrow 9*h*; and from the wellhead 12 to the wellbore 2, as indicated by the arrow 9*i*.

In contrast, the second flow path varies depending on the position of the isolation sleeve 60 relative to the isolation spool 58, which position changes as the isolation sleeve 60 is moved in the opposing directions 5 and 6, but the second flow path always includes the isolation sleeve 60. For example, when the isolation sleeve 60 is moved in the direction 6 such that the lower packoff assembly 100 extends within the isolation spool 58 and the upper packoff assembly 86 extends within the valve stack 20 and/or the frac tree 28, the second flow path is indicated by arrows 9*a*, 9*b*, 9*d*, 9*f*, 9*h*, 9*i*. Specifically, when the lower packoff assembly 100 extends within the isolation spool 58 and the upper packoff assembly 86 extends within the valve stack 20 and/or the frac tree 28, the fluid traveling along the second flow path is communicated: from the frac pump(s) 8 to the frac tree 28, as indicated by the arrow 9*a*; from the frac tree 28 to the valve stack 20, as indicated by the arrow 9*b*; from the valve stack 20 to the isolation sleeve 60, as indicated by the arrow 9*d*; from the isolation sleeve 60 to the isolation spool 58, as indicated by the arrow 9*f*; from the isolation spool 58 to the wellhead 12, as indicated by the arrow 9*h*; and from the wellhead 12 to the wellbore 2, as indicated by the arrow 9*i*.

For another example, when the mandrel assembly 4 extends within the isolation spool 58 but neither the upper packoff assembly 86 nor the lower packoff assembly 100 extends within the isolation spool 58, the second flow path is indicated by arrows 9*a*, 9*b*, 9*d*, 9*g*, 9*i*. Specifically, when the mandrel assembly 4 extends within the isolation spool 58 but neither the upper packoff assembly 86 nor the lower packoff assembly 100 extends within the isolation spool 58, the fluid traveling along the second flow path is communicated: from the frac pump(s) 8 to the frac tree 28, as indicated by the arrow 9*a*; from the frac tree 28 to the valve stack 20, as indicated by the arrow 9*b*; from the valve stack 20 to the isolation sleeve 60, as indicated by the arrow 9*d*; from the isolation sleeve 60 to the wellhead 12, as indicated by the arrow 9*g*; and from the wellhead 12 to the wellbore 2, as indicated by the arrow 9*i*.

For yet another example, when the isolation sleeve 60 is moved in the direction 5 such that the upper packoff assembly 86 extends within the isolation spool 58 and the lower packoff assembly 100 extends within the wellhead 12 (but before the upper and lower packoff assemblies 86 and 100 are sealingly engaged with the upper and lower packoff surfaces 3 and 7, respectively), the second flow path is indicated by arrows 9*a*, 9*b*, 9*c*, 9*e*, 9*g*, 9*i*. Specifically, when the upper packoff assembly 86 extends within the isolation spool 58 and the lower packoff assembly 100 extends within the wellhead 12 (but before the upper and lower packoff assemblies 86 and 100 are sealingly engaged with the upper and lower packoff surfaces 3 and 7, respectively), the fluid traveling along the second flow path is communicated: from the frac pump(s) 8 to the frac tree 28, as indicated by the arrow 9*a*; from the frac tree 28 to the valve stack 20, as indicated by the arrow 9*b*; from the valve stack 20 to the isolation spool 58, as indicated by the arrow 9*c*; from the isolation spool 58 to the isolation sleeve 60, as indicated by the arrow 9*e*; from the isolation sleeve 60 to the wellhead 12, as indicated by the arrow 9*g*; and from the wellhead 12 to the wellbore 2, as indicate by the arrow 9*i*.

Figure 11A:
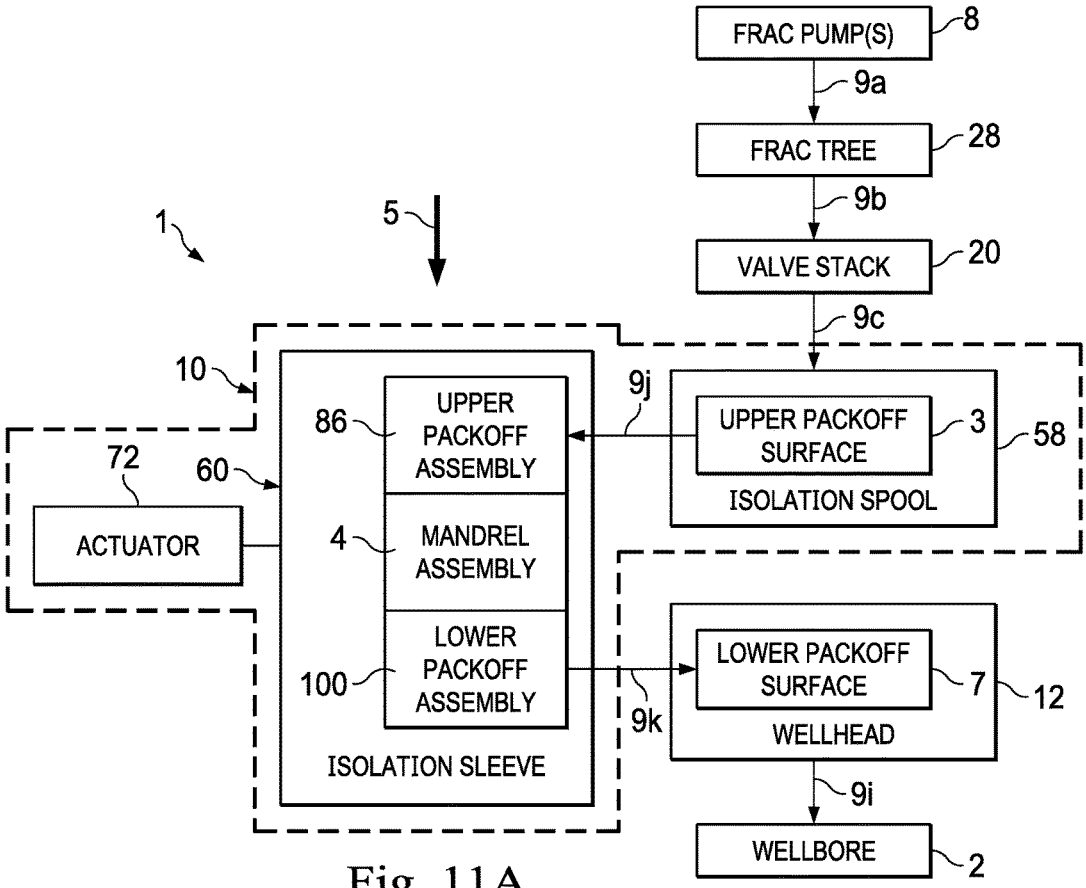
FIG. 11A is a diagrammatic illustration of the frac system similar to that shown in FIG. 1A, except that the isolation sleeve is repositioned to fluidically isolate at least a portion of a wellhead from fluid flowing through the isolation head, according to one or more embodiments of the present disclosure.

Referring to FIG. 11A with continuing reference to FIG. 1A, after the isolation valve 18 is opened, the isolation sleeve 60 can be actuated in the direction 5 to sealingly engage the upper and lower packoff assemblies 86 and 100 with the upper and lower packoff surfaces 3 and 7, respectively, so that at least a portion of the wellhead 12 is fluidically isolated from fluid flowing through the isolation head 10 during the wellbore operation. Such isolation of the at least a portion of the wellhead 12 from the fluid flowing through the isolation head 10 is accomplished by cutting off the first flow path along which the fluid is permitted to be communicated from the frac pump(s) to the wellbore 2 (shown in FIG. 1A). More particularly, the sealing engagement of the upper and lower packoff assemblies 86 and 100 with the upper and lower packoff surfaces 3 and 7, respectively, cuts off at least the portion of the first flow path represented by the arrow 9*h* in FIG. 1A. As a result, the frac pump(s) 8 are only allowed to communicate fluid to the wellbore along one flow path, which is indicated by arrows 9*a*, 9*b*, 9*c*, 9*j*, 9*k*, and 9*i*. Specifically, when the upper and lower packoff assemblies 86 and 100 are sealingly engaged with the upper and lower packoff surfaces 3 and 7, respectively, the fluid traveling along the one flow path is communicated: from the frac pump(s) 8 to the frac tree 28, as indicated by the arrow 9*a*; from the frac tree 28 to the valve stack 20, as indicated by the arrow 9*b*; from the valve stack 20 to the isolation spool 58, as indicated by the arrow 9*c*; from the isolation spool 58 to the isolation sleeve 60, as indicated by the arrow 9*j*; from the isolation sleeve 60 to the wellhead 12, as indicated by the arrow 9*k*; and from the wellhead 12 to the wellbore 2, as indicated by the arrow 9*i*.

Figure 11B:
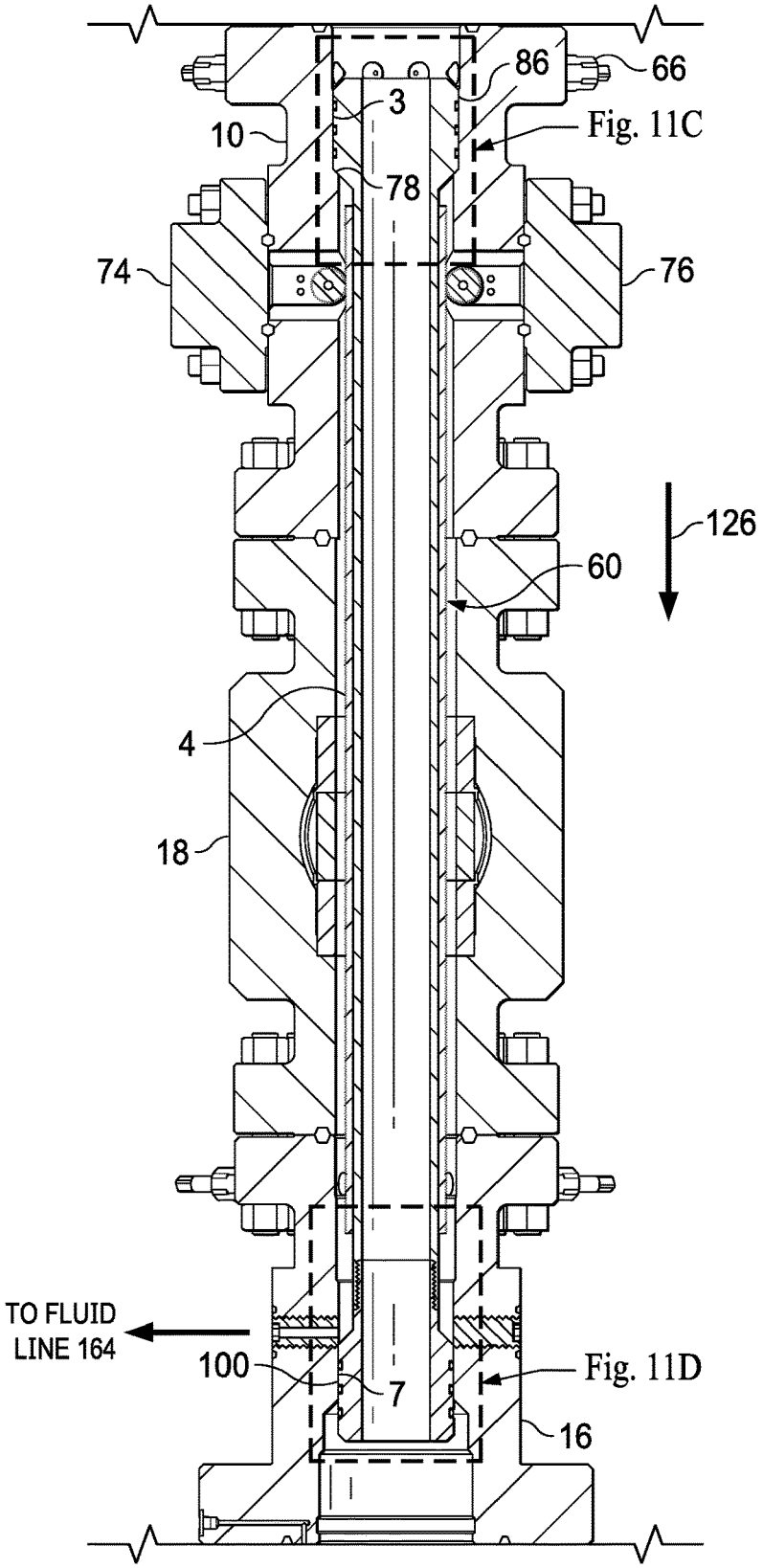
FIG. 11B is a partial cross-sectional view of the frac system of FIG. 10 in a third operational state or configuration, which third operational state or configuration is also illustrated diagrammatically in FIG. 11A, according to one or more embodiments of the present disclosure.
Figure 11C:
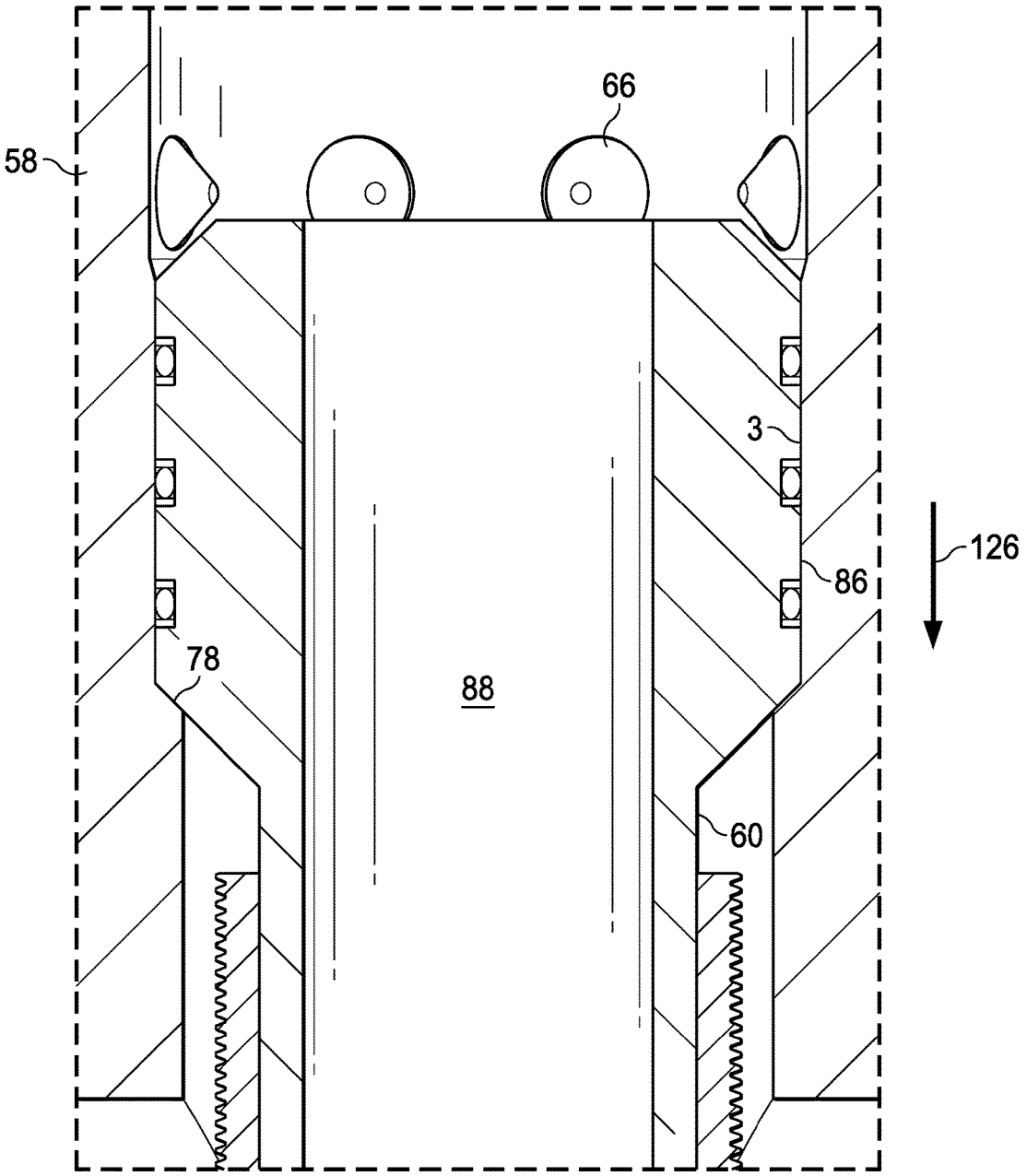
FIG. 11C is an enlarged view of a portion of FIG. 11B, according to one or more embodiments of the present disclosure.
Figure 11D:
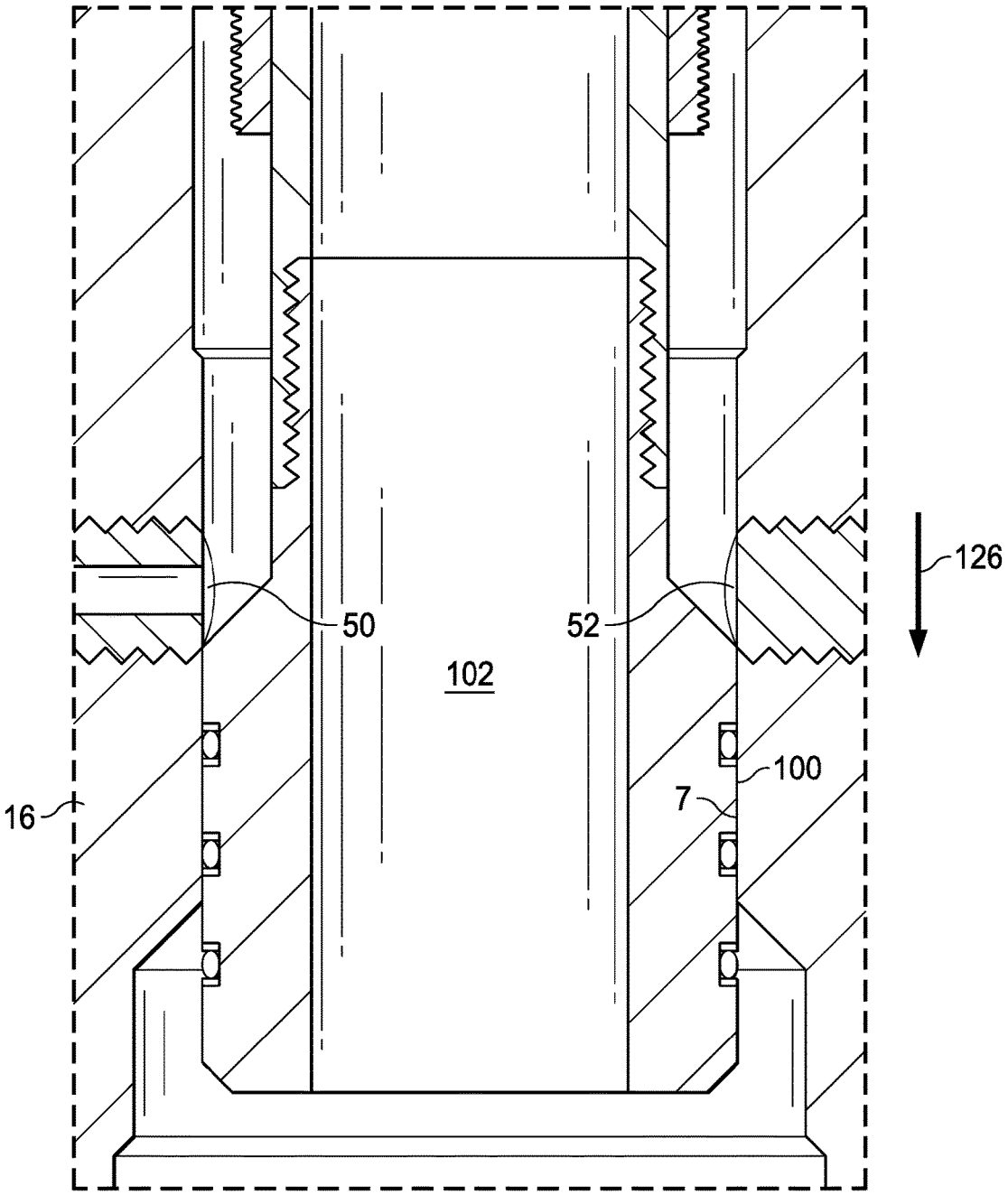
FIG. 11D is an enlarged view of another portion of FIG. 11B, according to one or more embodiments of the present disclosure.

Turning briefly back to FIG. 5, in order to move the isolation sleeve 60 in the direction 126 (which is analogous to the direction 5 shown in FIG. 11A) after the isolation valve 18 is opened, the input driveshaft 108 of the actuator 72 can be rotated in one direction (e.g., clockwise) to drive the input gearbox 110 and the output gearboxes 111 and 112 so that the output driveshafts 114 and 116 rotate the pinion gears 118 and 120 in the directions 122 and 124, thereby causing the isolation sleeve 60 to move longitudinally in the direction 126 (also shown in FIGS. 11B-11D). This rotation of the input driveshaft 108 in the one direction (e.g., clockwise) to move the isolation sleeve 60 longitudinally in the direction 126 is continued until the upper packoff assembly 86 engages the landing shoulder 78 of the isolation spool 58, as shown in FIGS. 11B and 11C. The lockdown pins 66 are then used to secure the isolation sleeve 60 against the landing shoulder 78 of the isolation spool 58. In some embodiments, the valve stack 20 acts as a lubricator to facilitate the movement of the isolation sleeve 60 longitudinally in the direction 126. More particularly, once the isolation valve 18 is opened, fluid is communicated from the wellhead 12 to the valve stack 20 through the isolation head 10 so that fluid pressures acting longitudinally on opposing end portions of the isolation sleeve 60 are equal. As a result, the force required to move the isolation sleeve 60 in the direction 126 is reduced as compared to existing isolation tools. Moreover, in those embodiments in which the diameter D2 of the lower packoff assembly 100 is less than the diameter D1 of the upper packoff assembly 86, the fluid pressures acting longitudinally on the opposing end portions of the isolation sleeve 60 bias the isolation sleeve 60 in the direction 126 when the isolation valve 18 is in the open configuration.

In some embodiments, when the upper packoff assembly 86 engages the landing shoulder 78 of the isolation spool 58, the upper packoff assembly 86 sealingly engages an internal surface of the isolation spool 58, which internal surface acts as the upper packoff surface 3, as shown in FIGS. 11B and 11C, while the lower packoff assembly 100 sealingly engages an internal surface of the tubing spool 16, which internal surface acts as the lower packoff surface 7, as shown in FIGS. 11B and 11D. For example, the internal surface of the tubing spool that acts as the lower packoff surface 7 may be located below (as viewed in FIGS. 11B and 11D) the access ports 50 and 52; as a result, the access port 50 and/or the access port 52 can be used to pressure test the effectiveness of the seals created by the engagement of the lower packoff assembly 100 with the lower packoff surface 7, the engagement of the upper packoff assembly 86 with the upper packoff surface 3, or both. Although the internal surface of the isolation spool 58 is described herein as acting as the upper packoff surface 3, another surface of the isolation spool 58, the valve stack 20, the frac tree 28, or any combination thereof, may instead act as the upper packoff surface 3. In addition, although the internal surface of the tubing spool 16 is described herein as acting as the lower packoff surface 7, another surface of the tubing spool 16, some other component of the wellhead 12, or any combination thereof, may instead act as the lower packoff surface 7.

After the upper packoff assembly 86 is sealingly engaged with the upper packoff surface 3, as shown in FIGS. 11B and 11C, and the lower packoff assembly 100 is sealingly engaged with the lower packoff surface 7, as shown in FIGS. 11B and 11D, the valve 22 and/or the valve 24 is/are closed, the blind flange 163 is removed from the valve stack 20, and the frac tree 28 is connected to the valve stack 20 (as shown in FIG. 1B) to facilitate, for example, fracturing and/or gravel packing of the wellbore 2. Once the frac tree 28 is connected to the valve stack 20, the valves 22 and 24 can each be opened so that fracturing or gravel packing fluid can be communicated into the fluid inlets 34 of the goat head 30, as indicated by the arrows 36 in FIG. 1B. The fracturing and/or gravel packing fluid travels through the valve stack 20, through the isolation head 10 (including the isolation spool 58 and the internal passages 88 and 102 of the isolation sleeve 60), and into the wellbore 2. During this communication of the fracturing or gravel packing fluid to the wellbore 2, the isolation sleeve 60 fluidically isolates the at least part of the wellhead 12 so that the fracturing or gravel packing fluid does not come into contact with the at least part of the wellhead 12. In some embodiments, the at least part of the wellhead 12 isolated from the fracturing or gravel packing fluid includes the isolation valve 18. In some embodiments, a length of the isolation sleeve 60 is variable to adapt the isolation head 10 for use with a wellhead having different dimensions than the wellhead 12 by, for example, interchanging the mandrel extension 82 with another mandrel extension substantially identical to the mandrel extension 82 but having a different length.

Figure 12:
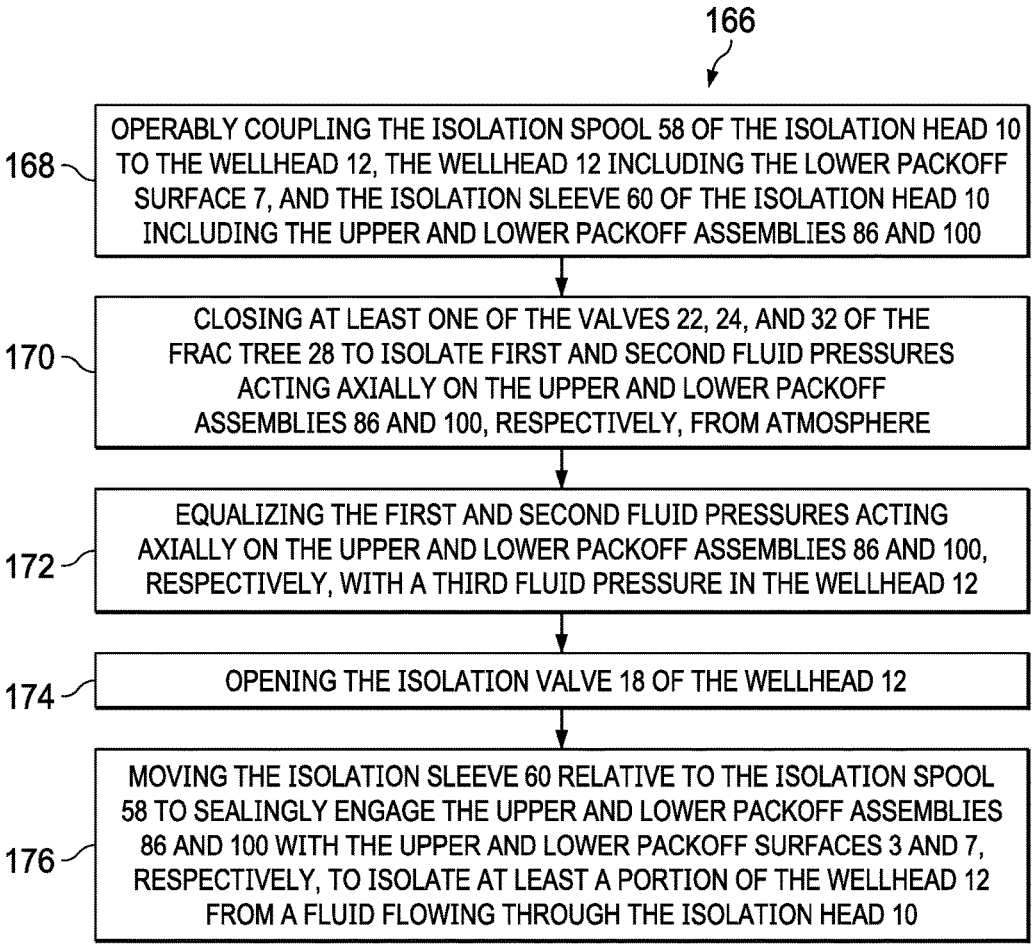
FIG. 12 is a flow diagram of a method for implementing one or more embodiments of the present disclosure.

Referring to FIG. 12, a method of operating the frac system 1 is generally referred to by the reference numeral 166. The method 166 includes at a step 168, operably coupling the isolation spool 58 of the isolation head 10 to the wellhead 12, the wellhead 12 including the lower packoff surface 7, and the isolation sleeve 60 of the isolation head 10 including the upper and lower packoff assemblies 86 and 100. At a step 170, at least one of the valves 22, 24, and 32 of the frac tree 28 is closed to isolate first and second fluid pressures acting axially on the upper and lower packoff assemblies 86 and 100, respectively, from atmosphere. At a step 172, the first and second fluid pressures acting axially on the upper and lower packoff assemblies 86 and 100, respectively, are equalized with a third fluid pressure in the wellhead 12. In some embodiments, the step 172 includes placing the wellhead 12 and the isolation head 10 in fluid communication via the fluid line 164 to bypass the isolation valve 18. At a step 174, the isolation valve 18 is opened. At a step 176, the isolation sleeve 60 is moved relative to the isolation spool 58 to sealingly engage the upper and lower packoff assemblies 86 and 100 with the upper and lower packoff surfaces 3 and 7, respectively, to isolate at least a portion of the wellhead 12 from a fluid flowing through the isolation head 10. In some embodiments, the at least a portion of the wellhead isolated from the fluid flowing through the isolation head includes the isolation valve 18. In some embodiments, the step 176 includes engaging the actuator to move the isolation sleeve relative to the isolation spool. In some embodiments, the upper packoff surface 3 is part the isolation spool 58. In other embodiments, the upper packoff surface 3 is part of the frac tree 28 operably coupled to the isolation spool 58 opposite the wellhead 12.

In some embodiments, among other things, the operation of the frac system 1 (i.e., the isolation sleeve 60's fluidic isolation of the at least part of the wellhead 12 during the fracturing or gravel packing operation) and/or the execution of the method 166: effectively increases the pressure rating of the wellhead 12 (e.g., from 5 ksi to 10 ksi, from 10 ksi to 15 ksi, or the like) so that the wellhead 12 itself does not have to be upgraded to perform certain wellbore operations; protects the at least part of the wellhead 12 from erosion during the fracturing or gravel packing operation; and allows for rapid shut in of the wellbore 2 if unsafe conditions develop (or are about to develop), thereby preventing (or stopping) the uncontrolled release of hydrocarbons from the wellbore 2 (i.e., a blowout). Furthermore, among other things, because the fluid pressures acting longitudinally on the opposing end portions of the isolation sleeve 60 are equal: the isolation head 10 does not encounter "lifting off" of the isolation sleeve 60 in the same way existing isolation tools encounter "lifting off" of their mandrels; and the isolation sleeve 60 can easily be moved by the actuator 72, even when unsafe conditions develop. For these reasons, unsafe conditions are much less likely to develop during use of the isolation head 10 than during use of existing isolation tools and, should such unsafe conditions develop, the input driveshaft 108 can be rotated in the opposite direction (e.g., counterclockwise) (as shown in FIG. 5) to drive the input gearbox 110 and the output gearboxes 111 and 112 so that the output driveshafts 114 and 116 rotate the pinion gears 118 and 120 in directions opposite the directions 122 and 124, respectively, thereby causing the isolation sleeve 60 to move longitudinally in a direction opposite the direction 126. Once the isolation sleeve 60 has been so moved far enough to clear the isolation valve 18, the isolation valve 18 can be closed to shut in the wellbore 2. In some embodiments, since the isolation valve 18 was not exposed to excessive pressures, temperatures, and/or flow rates during the fracturing or gravel packing of the wellbore 2, the isolation valve 18 is better suited to stop or prevent such a blowout than existing isolation tools.

Figure 13:
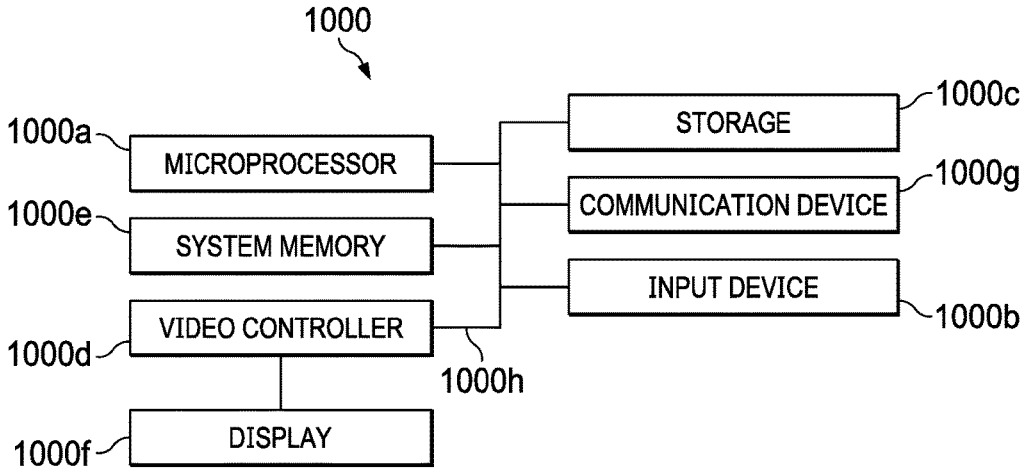
FIG. 13 is a diagrammatic illustration of a computing node for implementing one or more embodiments of the present disclosure.

Referring to FIG. 13, in an embodiment, a computing node 1000 for implementing one or more embodiments of one or more of the above-described elements, systems (e.g., 1), methods (e.g., 166) and/or steps (e.g., 168, 170, 172, 174, and/or 176), or any combination thereof, is depicted. The node 1000 includes a microprocessor 1000*a*, an input device 1000*b*, a storage device 1000*c*, a video controller 1000*d*, a system memory 1000*e*, a display 1000*f*, and a communication device 1000*g* all interconnected by one or more buses 1000*h*. In several embodiments, the storage device 1000*c* may include a floppy drive, hard drive, CD-ROM, optical drive, any other form of storage device or any combination thereof. In several embodiments, the storage device 1000*c* may include, and/or be capable of receiving, a floppy disk, CD-ROM, DVD-ROM, or any other form of computer-readable medium that may contain executable instructions. In several embodiments, the communication device 1000*g* may include a modem, network card, or any other device to enable the node 1000 to communicate with other nodes. In several embodiments, any node represents a plurality of interconnected (whether by intranet or Internet) computer systems, including without limitation, personal computers, mainframes, PDAs, smartphones and cell phones.

In several embodiments, one or more of the components of any of the above-described systems include at least the node 1000 and/or components thereof, and/or one or more nodes that are substantially similar to the node 1000 and/or components thereof. In several embodiments, one or more of the above-described components of the node 1000 and/or the above-described systems include respective pluralities of same components.

In several embodiments, a computer system typically includes at least hardware capable of executing machine readable instructions, as well as the software for executing acts (typically machine-readable instructions) that produce a desired result. In several embodiments, a computer system may include hybrids of hardware and software, as well as computer sub-systems.

In several embodiments, hardware generally includes at least processor-capable platforms, such as client-machines (also known as personal computers or servers), and hand-held processing devices (such as smart phones, tablet computers, personal digital assistants (PDAs), or personal computing devices (PCDs), for example). In several embodiments, hardware may include any physical device that is capable of storing machine-readable instructions, such as memory or other data storage devices. In several embodiments, other forms of hardware include hardware sub-systems, including transfer devices such as modems, modem cards, ports, and port cards, for example.

In several embodiments, software includes any machine code stored in any memory medium, such as RAM or ROM, and machine code stored on other devices (such as floppy disks, flash memory, or a CD ROM, for example). In several embodiments, software may include source or object code. In several embodiments, software encompasses any set of instructions capable of being executed on a node such as, for example, on a client machine or server.

In several embodiments, combinations of software and hardware could also be used for providing enhanced functionality and performance for certain embodiments of the present disclosure. In an embodiment, software functions may be directly manufactured into a silicon chip. Accordingly, it should be understood that combinations of hardware and software are also included within the definition of a computer system and are thus envisioned by the present disclosure as possible equivalent structures and equivalent methods.

In several embodiments, computer readable mediums include, for example, passive data storage, such as a random-access memory (RAM) as well as semi-permanent data storage such as a compact disk read only memory (CD-ROM). One or more embodiments of the present disclosure may be embodied in the RAM of a computer to transform a standard computer into a new specific computing machine. In several embodiments, data structures are defined organizations of data that may enable an embodiment of the present disclosure. In an embodiment, data structure may provide an organization of data, or an organization of executable code.

In several embodiments, any networks and/or one or more portions thereof, may be designed to work on any specific architecture. In an embodiment, one or more portions of any networks may be executed on a single computer, local area networks, client-server networks, wide area networks, internets, hand-held and other portable and wireless devices and networks.

In several embodiments, database may be any standard or proprietary database software. In several embodiments, the database may have fields, records, data, and other database elements that may be associated through database specific software. In several embodiments, data may be mapped. In several embodiments, mapping is the process of associating one data entry with another data entry. In an embodiment, the data contained in the location of a character file can be mapped to a field in a second table. In several embodiments, the physical location of the database is not limiting, and the database may be distributed. In an embodiment, the database may exist remotely from the server, and run on a separate platform. In an embodiment, the database may be accessible across the Internet. In several embodiments, more than one database may be implemented.

In several embodiments, a plurality of instructions stored on a computer readable medium may be executed by one or more processors to cause the one or more processors to carry out or implement in whole or in part the above-described operation of each of the above-described elements, systems (e.g., 1), methods (e.g., 166) and/or steps (e.g., 168, 170, 172, 174, and/or 176), or any combination thereof. In several embodiments, such a processor may include one or more of the microprocessor 1000*a*, any processor(s) that are part of the components of the above-described systems, and/or any combination thereof, and such a computer readable medium may be distributed among one or more components of the above-described systems. In several embodiments, such a processor may execute the plurality of instructions in connection with a virtual computer system. In several embodiments, such a plurality of instructions may communicate directly with the one or more processors, and/or may interact with one or more operating systems, middleware, firmware, other applications, and/or any combination thereof, to cause the one or more processors to execute the instructions.

A system has been disclosed. The system generally includes a wellhead that serves as a surface termination of a wellbore that traverses a subterranean formation, the wellhead including a lower packoff surface. An isolation head of the system includes an isolation spool operably coupled to the wellhead and an isolation sleeve including upper and lower packoff assemblies. The system also includes an upper packoff surface that is either: part the isolation spool; or part of a frac tree operably coupled to the isolation spool opposite the wellhead. The isolation sleeve is movable relative to the isolation spool to sealingly engage the upper and lower packoff assemblies with the upper and lower packoff surfaces, respectively. When the upper and lower packoff assemblies are sealingly engaged with the upper and lower packoff surfaces, respectively, the isolation sleeve isolates at least a portion of the wellhead from a fluid flowing through the isolation head.

The foregoing system embodiment may include one or more of the following elements, either alone or in combination with one another:

- An actuator operably coupling the isolation sleeve to the isolation spool and adapted to move the isolation sleeve relative to the isolation spool.
- The actuator includes: a rack gear operably associated with the isolation sleeve; and a pinion gear engageable with the rack gear to move the isolation sleeve.
- The isolation spool defines an internal passage; and the isolation sleeve extends within the internal passage of the isolation spool.
- The system further includes the frac tree; wherein the frac tree includes one or more valves adapted to be closed to isolate first and second fluid pressures acting axially on the upper and lower packoff assemblies, respectively, from atmosphere.
- The first and second fluid pressures acting axially on the upper and lower packoff assemblies, respectively, are adapted to be equalized to facilitate movement of the isolation sleeve relative to the isolation spool.
- The wellhead includes an isolation valve positioned between the lower packoff surface and the isolation spool and adapted to be opened and closed; and the at least a portion of the wellhead isolated from the fluid flowing through the isolation head when the upper and lower packoff assemblies are sealingly engaged with the upper and lower packoff surfaces, respectively, includes the isolation valve.
- First and second fluid pressures acting axially on the upper and lower packoff assemblies, respectively, are adapted to be equalized with a third fluid pressure in the wellhead to facilitate: the opening of the isolation valve; and the movement of the isolation sleeve relative to the isolation spool.
- A fluid line is adapted to bypass the isolation valve and to place the wellhead and the isolation head in fluid communication so that the first and second fluid pressures acting axially on the upper and lower packoff assemblies, respectively, are equalized with the third fluid pressure in the wellhead.

A method has also been disclosed. The method generally includes operably coupling an isolation spool of an isolation head to a wellhead that serves as a surface termination of a wellbore that traverses a subterranean formation, the wellhead including a lower packoff surface, and the isolation head further including an isolation sleeve including upper and lower packoff assemblies; and moving the isolation sleeve relative to the isolation spool to sealingly engage the upper and lower packoff assemblies with an upper packoff surface and the lower packoff surface, respectively. When the upper and lower packoff assemblies are sealingly engaged with the upper and lower packoff surfaces, respectively, the isolation sleeve isolates at least a portion of the wellhead from a fluid flowing through the isolation head. Either: the upper packoff surface is part the isolation spool; or the upper packoff surface is part of a frac tree operably coupled to the isolation spool opposite the wellhead.

The foregoing method embodiment may include one or more of the following elements, either alone or in combination with one another:

Moving the isolation sleeve relative to the isolation spool includes engaging an actuator that operably couples the isolation sleeve to the isolation spool to move the isolation sleeve relative to the isolation spool.

The actuator includes: a rack gear operably associated with the isolation sleeve; and a pinion gear engageable with the rack gear to move the isolation sleeve.

The isolation spool defines an internal passage; and the isolation sleeve extends within the internal passage of the isolation spool.

The method further includes closing one or more valves of the frac tree to isolate first and second fluid pressures acting axially on the upper and lower packoff assemblies, respectively, from atmosphere.

The method further includes, before moving the isolation sleeve relative to the isolation spool, equalizing the first and second fluid pressures acting axially on the upper and lower packoff assemblies, respectively, to facilitate movement of the isolation sleeve relative to the isolation spool.

The wellhead includes an isolation valve positioned between the lower packoff surface and the isolation spool; and the at least a portion of the wellhead isolated from the fluid flowing through the isolation head when the upper and lower packoff assemblies are sealingly engaged with the upper and lower packoff surfaces, respectively, includes the isolation valve.

The method further includes: opening the isolation valve; and before moving the isolation sleeve relative to the isolation spool, equalizing first and second fluid pressures acting axially on the upper and lower packoff assemblies, respectively, with a third fluid pressure in the wellhead to facilitate: the opening of the isolation valve; and the movement of the isolation sleeve relative to the isolation spool.

Equalizing the first and second fluid pressures acting axially on the upper and lower packoff assemblies, respectively, with the third fluid pressure in the wellhead includes: before opening the isolation valve, placing the wellhead and the isolation head in fluid communication via a fluid line to bypass the isolation valve so that the first and second fluid pressures acting axially on the upper and lower packoff assemblies, respectively, are equalized with the third fluid pressure in the wellhead.

An apparatus has also been disclosed. The apparatus generally includes an isolation spool adapted to be operably coupled to a wellhead that serves as a surface termination of a wellbore that traverses a subterranean formation, the wellhead including a lower packoff surface; an isolation sleeve including upper and lower packoff assemblies; and an upper packoff surface; wherein the isolation sleeve is movable relative to the isolation spool to sealingly engage the upper and lower packoff assemblies with the upper and lower packoff surfaces, respectively; wherein, when the upper and lower packoff assemblies are sealingly engaged with the upper and lower packoff surfaces, respectively, the isolation sleeve isolates at least a portion of the wellhead from a fluid flowing through the apparatus; and wherein either: the upper packoff surface is part the isolation spool; or the upper packoff surface is part of a frac tree adapted to be operably coupled to the isolation spool opposite the wellhead.

The foregoing apparatus embodiment may include one or more of the following elements, either alone or in combination with one another:

An actuator operably coupling the isolation sleeve to the isolation spool and adapted to move the isolation sleeve relative to the isolation spool.

The actuator includes: a rack gear operably associated with the isolation sleeve; and a pinion gear engageable with the rack gear to move the isolation sleeve.

The isolation spool defines an internal passage; and the isolation sleeve extends within the internal passage of the isolation spool.

The apparatus further includes the frac tree; wherein the frac tree includes one or more valves adapted to be closed to isolate first and second fluid pressures acting axially on the upper and lower packoff assemblies, respectively, from atmosphere.

The first and second fluid pressures acting axially on the upper and lower packoff assemblies, respectively, are adapted to be equalized to facilitate movement of the isolation sleeve relative to the isolation spool.

The apparatus further includes the wellhead; wherein the wellhead includes an isolation valve positioned between the lower packoff surface and the isolation spool and adapted to be opened and closed; and wherein the at least a portion of the wellhead isolated from the fluid flowing through the apparatus when the upper and lower packoff assemblies are sealingly engaged with the upper and lower packoff surfaces, respectively, includes the isolation valve.

First and second fluid pressures acting axially on the upper and lower packoff assemblies, respectively, are adapted to be equalized with a third fluid pressure in the wellhead to facilitate: the opening of the isolation valve; and the movement of the isolation sleeve relative to the isolation spool.

A fluid line is adapted to bypass the isolation valve and to place the wellhead and the apparatus in fluid communication so that the first and second fluid pressures acting axially on the upper and lower packoff assemblies, respectively, are equalized with the third fluid pressure in the wellhead.

It is understood that variations may be made in the foregoing without departing from the scope of the present disclosure.

In some embodiments, the elements and teachings of the various embodiments may be combined in whole or in part in some or all of the embodiments. In addition, one or more of the elements and teachings of the various embodiments may be omitted, at least in part, and/or combined, at least in part, with one or more of the other elements and teachings of the various embodiments.

Any spatial references, such as, for example, "upper," "lower," "above," "below," "between," "bottom," "vertical," "horizontal," "angular," "upwards," "downwards," "side-to-side," "left-to-right," "right-to-left," "top-to-bottom," "bottom-to-top," "top," "bottom," "bottom-up," "top-down," etc., are for the purpose of illustration only and do not limit the specific orientation or location of the structure described above.

In some embodiments, while different steps, processes, and procedures are described as appearing as distinct acts, one or more of the steps, one or more of the processes, and/or one or more of the procedures may also be performed in different orders, simultaneously and/or sequentially. In some embodiments, the steps, processes, and/or procedures may be merged into one or more steps, processes and/or procedures.

In some embodiments, one or more of the operational steps in each embodiment may be omitted. Moreover, in some instances, some features of the present disclosure may be employed without a corresponding use of the other features. Moreover, one or more of the above-described embodiments and/or variations may be combined in whole or in part with any one or more of the other above-described embodiments and/or variations.

Although some embodiments have been described in detail above, the embodiments described are illustrative only and are not limiting, and those skilled in the art will readily appreciate that many other modifications, changes and/or substitutions are possible in the embodiments without materially departing from the novel teachings and advantages of the present disclosure. Accordingly, all such modifications, changes, and/or substitutions are intended to be included within the scope of this disclosure as defined in the following claims. In the claims, any means-plus-function clauses are intended to cover the structures described herein as performing the recited function and not only structural equivalents, but also equivalent structures. Moreover, it is the express intention of the applicant not to invoke 35 U.S.C. § 112, paragraph 6 for any limitations of any of the claims herein, except for those in which the claim expressly uses the word "means" together with an associated function.

What is claimed is:

1. A system, comprising:

a wellhead that serves as a surface termination of a wellbore that traverses a subterranean formation;

an isolation head, comprising:

an isolation spool operably coupled to the wellhead; and an isolation sleeve including upper and lower packoff assemblies;

a lower packoff surface; and an upper packoff surface;

wherein the isolation sleeve is movable relative to the isolation spool to sealingly engage the upper and lower packoff assemblies with the upper and lower packoff surfaces, respectively;

wherein, when the upper and lower packoff assemblies are sealingly engaged with the upper and lower packoff surfaces, respectively, the isolation sleeve isolates at least a portion of the wellhead from a fluid flowing through the isolation head; and wherein the system is adapted such that first and second fluid pressures acting axially on the upper and lower packoff assemblies, respectively, may be equalized to facilitate the movement of the isolation sleeve relative to the isolation spool.

2. The system of claim 1, further comprising an actuator operably coupling the isolation sleeve to the isolation spool and adapted to move the isolation sleeve relative to the isolation spool.

3. The system of claim 2, wherein the actuator comprises:

a rack gear operably associated with the isolation sleeve; and a pinion gear engageable with the rack gear to move the isolation sleeve.

4. The system of claim 1, wherein the isolation spool defines an internal passage; and wherein the isolation sleeve extends within the internal passage of the isolation spool.

5. The system of claim 1, further comprising a frac tree;

wherein the frac tree includes one or more valves adapted to be closed to isolate the first and second fluid pressures acting axially on the upper and lower packoff assemblies, respectively, from atmosphere.

6. The system of claim 1, wherein the wellhead includes an isolation valve positioned between the lower packoff surface and the isolation spool and adapted to be opened and closed; and wherein the at least a portion of the wellhead isolated from the fluid flowing through the isolation head when the upper and lower packoff assemblies are sealingly engaged with the upper and lower packoff surfaces, respectively, includes the isolation valve.

7. A system, comprising:

a wellhead that serves as a surface termination of a wellbore that traverses a subterranean formation, the wellhead including a lower packoff surface;

an isolation head, comprising:

an isolation spool operably coupled to the wellhead; and an isolation sleeve including upper and lower packoff assemblies;

and an upper packoff surface;

wherein the isolation sleeve is movable relative to the isolation spool to sealingly engage the upper and lower packoff assemblies with the upper and lower packoff surfaces, respectively;

wherein, when the upper and lower packoff assemblies are sealingly engaged with the upper and lower packoff surfaces, respectively, the isolation sleeve isolates at least a portion of the wellhead from a fluid flowing through the isolation head;

wherein the system further comprises a frac tree;

wherein the frac tree includes one or more valves adapted to be closed to isolate first and second fluid pressures acting axially on the upper and lower packoff assemblies, respectively, from atmosphere; and wherein the system is adapted such that the first and second fluid pressures acting axially on the upper and lower packoff assemblies, respectively, may be equalized to facilitate movement of the isolation sleeve relative to the isolation spool.

8. A system, comprising:

a wellhead that serves as a surface termination of a wellbore that traverses a subterranean formation, the wellhead including a lower packoff surface;

an isolation head, comprising:

an isolation spool operably coupled to the wellhead; and an isolation sleeve including upper and lower packoff assemblies;

and an upper packoff surface;

wherein the isolation sleeve is movable relative to the isolation spool to sealingly engage the upper and lower packoff assemblies with the upper and lower packoff surfaces, respectively;

wherein, when the upper and lower packoff assemblies are sealingly engaged with the upper and lower packoff surfaces, respectively, the isolation sleeve isolates at least a portion of the wellhead from a fluid flowing through the isolation head;

wherein the wellhead includes an isolation valve positioned between the lower packoff surface and the isolation spool and adapted to be opened and closed;

wherein the at least a portion of the wellhead isolated from the fluid flowing through the isolation head when the upper and lower packoff assemblies are sealingly engaged with the upper and lower packoff surfaces, respectively, includes the isolation valve; and wherein the system is adapted such that first and second fluid pressures acting axially on the upper and lower packoff assemblies, respectively, may be equalized with a third fluid pressure in the wellhead to facilitate:

the opening of the isolation valve; and the movement of the isolation sleeve relative to the isolation spool.

9. The system of claim 8, further comprising a fluid line adapted to bypass the isolation valve and to place the wellhead and the isolation head in fluid communication so that the first and second fluid pressures acting axially on the upper and lower packoff assemblies, respectively, are equalized with the third fluid pressure in the wellhead.

10. A method, comprising:

operably coupling an isolation spool of an isolation head to a wellhead that serves as a surface termination of a wellbore that traverses a subterranean formation, the isolation head comprising an isolation sleeve including upper and lower packoff assemblies; and moving the isolation sleeve relative to the isolation spool to sealingly engage a upper and lower packoff assemblies with an upper packoff surface and a lower packoff surface, respectively;

wherein, when the upper and lower packoff assemblies are sealingly engaged with the upper and lower packoff surfaces, respectively, the isolation sleeve isolates at least a portion of the wellhead from a fluid flowing through the isolation head; and wherein the method further comprises:

before moving the isolation sleeve relative to the isolation spool, equalizing first and second fluid pressures acting axially on the upper and lower packoff assemblies, respectively, to facilitate the movement of the isolation sleeve relative to the isolation spool.

11. The method of claim 10, wherein moving the isolation sleeve relative to the isolation spool comprises engaging an actuator that operably couples the isolation sleeve to the isolation spool to move the isolation sleeve relative to the isolation spool.

12. The method of claim 11, wherein the actuator comprises:

a rack gear operably associated with the isolation sleeve; and a pinion gear engageable with the rack gear to move the isolation sleeve.

13. The method of claim 10, wherein the isolation spool defines an internal passage; and wherein the isolation sleeve extends within the internal passage of the isolation spool.

14. The method of claim 10, further comprising:

closing one or more valves of a frac tree to isolate the first and second fluid pressures acting axially on the upper and lower packoff assemblies, respectively, from atmosphere.

15. The method of claim 10, wherein the wellhead includes an isolation valve positioned between the lower packoff surface and the isolation spool; and wherein the at least a portion of the wellhead isolated from the fluid flowing through the isolation head when the upper and lower packoff assemblies are sealingly engaged with the upper and lower packoff surfaces, respectively, includes the isolation valve.

16. A method, comprising:

operably coupling an isolation spool of an isolation head to a wellhead that serves as a surface termination of a wellbore that traverses a subterranean formation, the wellhead including a lower packoff surface, and the isolation head further comprising an isolation sleeve including upper and lower packoff assemblies; and moving the isolation sleeve relative to the isolation spool to sealingly engage the upper and lower packoff assemblies with an upper packoff surface and the lower packoff surface, respectively;

wherein, when the upper and lower packoff assemblies are sealingly engaged with the upper and lower packoff surfaces, respectively, the isolation sleeve isolates at least a portion of the wellhead from a fluid flowing through the isolation head; and wherein the method further comprises:

closing one or more valves of a frac tree to isolate first and second fluid pressures acting axially on the upper and lower packoff assemblies, respectively, from atmosphere; and before moving the isolation sleeve relative to the isolation spool, equalizing the first and second fluid pressures acting axially on the upper and lower packoff assemblies, respectively, to facilitate movement of the isolation sleeve relative to the isolation spool.

17. A method, comprising:

operably coupling an isolation spool of an isolation head to a wellhead that serves as a surface termination of a wellbore that traverses a subterranean formation, the wellhead including a lower packoff surface, and the isolation head further comprising an isolation sleeve including upper and lower packoff assemblies; and moving the isolation sleeve relative to the isolation spool to sealingly engage the upper and lower packoff assemblies with an upper packoff surface and the lower packoff surface, respectively;

wherein, when the upper and lower packoff assemblies are sealingly engaged with the upper and lower packoff surfaces, respectively, the isolation sleeve isolates at least a portion of the wellhead from a fluid flowing through the isolation head;

wherein the wellhead includes an isolation valve positioned between the lower packoff surface and the isolation spool;

wherein the at least a portion of the wellhead isolated from the fluid flowing through the isolation head when the upper and lower packoff assemblies are sealingly engaged with the upper and lower packoff surfaces, respectively, includes the isolation valve; and wherein the method further comprises:

opening the isolation valve; and before moving the isolation sleeve relative to the isolation spool, equalizing first and second fluid pressures acting axially on the upper and lower packoff assemblies, respectively, with a third fluid pressure in the wellhead to facilitate:

the opening of the isolation valve; and the movement of the isolation sleeve relative to the isolation spool.

18. The method of claim 17, wherein equalizing the first and second fluid pressures acting axially on the upper and lower packoff assemblies, respectively, with the third fluid pressure in the wellhead comprises:

before opening the isolation valve, placing the wellhead and the isolation head in fluid communication via a fluid line to bypass the isolation valve so that the first and second fluid pressures acting axially on the upper and lower packoff assemblies, respectively, are equalized with the third fluid pressure in the wellhead.

19. An apparatus, comprising:

an isolation spool adapted to be operably coupled to a wellhead that serves as a surface termination of a wellbore that traverses a subterranean formation;

an isolation sleeve including upper and lower packoff assemblies;

a lower packoff surface; and an upper packoff surface;

wherein the isolation sleeve is movable relative to the isolation spool to sealingly engage the upper and lower packoff assemblies with the upper and lower packoff surfaces, respectively;

wherein, when the upper and lower packoff assemblies are sealingly engaged with the upper and lower packoff surfaces, respectively, the isolation sleeve isolates at least a portion of the wellhead from a fluid flowing through the apparatus; and wherein the apparatus is adapted such that first and second fluid pressures acting axially on the upper and lower packoff assemblies, respectively, may be equalized to facilitate the movement of the isolation sleeve relative to the isolation spool.

20. The apparatus of claim 19, further comprising:

an actuator operably coupling the isolation sleeve to the isolation spool and adapted to move the isolation sleeve relative to the isolation spool.

21. The apparatus of claim 20, wherein the actuator comprises:

a rack gear operably associated with the isolation sleeve; and a pinion gear engageable with the rack gear to move the isolation sleeve.

22. The apparatus of claim 19, wherein the isolation spool defines an internal passage; and wherein the isolation sleeve extends within the internal passage of the isolation spool.

23. The apparatus of claim 19, further comprising a frac tree;

wherein the frac tree includes one or more valves adapted to be closed to isolate the first and second fluid pressures acting axially on the upper and lower packoff assemblies, respectively, from atmosphere.

24. The apparatus of claim 19, further comprising the wellhead;

wherein the wellhead includes an isolation valve positioned between the lower packoff surface and the isolation spool and adapted to be opened and closed; and wherein the at least a portion of the wellhead isolated from the fluid flowing through the apparatus when the upper and lower packoff assemblies are sealingly engaged with the upper and lower packoff surfaces, respectively, includes the isolation valve.

25. An apparatus, comprising:

an isolation spool adapted to be operably coupled to a wellhead that serves as a surface termination of a wellbore that traverses a subterranean formation, the wellhead including a lower packoff surface;

an isolation sleeve including upper and lower packoff assemblies; and an upper packoff surface;

wherein the isolation sleeve is movable relative to the isolation spool to sealingly engage the upper and lower packoff assemblies with the upper and lower packoff surfaces, respectively;

wherein, when the upper and lower packoff assemblies are sealingly engaged with the upper and lower packoff surfaces, respectively, the isolation sleeve isolates at least a portion of the wellhead from a fluid flowing through the apparatus;

wherein the apparatus further comprises a frac tree;

wherein the frac tree includes one or more valves adapted to be closed to isolate first and second fluid pressures acting axially on the upper and lower packoff assemblies, respectively, from atmosphere; and wherein the apparatus is adapted such that the first and second fluid pressures acting axially on the upper and lower packoff assemblies, respectively, may be equalized to facilitate movement of the isolation sleeve relative to the isolation spool.

26. An apparatus, comprising:

an isolation spool adapted to be operably coupled to a wellhead that serves as a surface termination of a wellbore that traverses a subterranean formation, the wellhead including a lower packoff surface;

an isolation sleeve including upper and lower packoff assemblies; and an upper packoff surface;

wherein the isolation sleeve is movable relative to the isolation spool to sealingly engage the upper and lower packoff assemblies with the upper and lower packoff surfaces, respectively;

wherein, when the upper and lower packoff assemblies are sealingly engaged with the upper and lower packoff surfaces, respectively, the isolation sleeve isolates at least a portion of the wellhead from a fluid flowing through the apparatus;

wherein the apparatus further comprises the wellhead;

wherein the wellhead includes an isolation valve positioned between the lower packoff surface and the isolation spool and adapted to be opened and closed;

wherein the at least a portion of the wellhead isolated from the fluid flowing through the apparatus when the upper and lower packoff assemblies are sealingly engaged with the upper and lower packoff surfaces, respectively, includes the isolation valve; and wherein the apparatus is adapted such that first and second fluid pressures acting axially on the upper and lower packoff assemblies, respectively, may be equalized with a third fluid pressure in the wellhead to facilitate:

the opening of the isolation valve; and the movement of the isolation sleeve relative to the isolation spool.

27. The apparatus of claim 26, further comprising a fluid line adapted to bypass the isolation valve and to place the wellhead and the apparatus in fluid communication so that the first and second fluid pressures acting axially on the upper and lower packoff assemblies, respectively, are equalized with the third fluid pressure in the wellhead.

* * * * *